US010905179B2

(12) United States Patent
Epperson et al.

(10) Patent No.: US 10,905,179 B2
(45) Date of Patent: Feb. 2, 2021

(54) WEARABLE DEVICES, ASSEMBLIES, SYSTEMS AND METHODS FOR TREATING SUBSTANCES ON SURFACES

(71) Applicants: Chad Epperson, Andover, MA (US); Lance Carter, Bradenton, FL (US)

(72) Inventors: Chad Epperson, Andover, MA (US); Lance Carter, Bradenton, FL (US)

( * ) Notice: Subject to any disclaimer, the term of this patent is extended or adjusted under 35 U.S.C. 154(b) by 277 days.

(21) Appl. No.: 15/837,131

(22) Filed: Dec. 11, 2017

(65) Prior Publication Data

US 2018/0160747 A1 Jun. 14, 2018

Related U.S. Application Data

(60) Provisional application No. 62/432,567, filed on Dec. 11, 2016.

(51) Int. Cl.

| | |
|---|---|
| ***A41D 13/05*** | (2006.01) |
| ***A41D 27/12*** | (2006.01) |
| ***A63B 71/12*** | (2006.01) |
| ***A41D 31/12*** | (2019.01) |

(52) U.S. Cl.

CPC ..... *A41D 13/0512* (2013.01); *A41D 13/0518* (2013.01); *A41D 27/12* (2013.01); *A41D 31/12* (2019.02); *A63B 71/12* (2013.01); *A41D 2600/10* (2013.01); *A63B 2071/1208* (2013.01)

(58) Field of Classification Search

CPC .... A41D 13/0512; A41D 27/12; A41D 31/12; A41D 13/0518; A41D 2600/10; A41D 13/0012; A41D 13/0015; A41D 13/015; A41D 13/0151; A41D 27/26; A41D 1/04; A41D 13/0002; A41D 31/04; A63B 71/12; A63B 2071/1208; F41H 1/02

USPC ..... 2/461, 462, 463, 268

See application file for complete search history.

(56) References Cited

U.S. PATENT DOCUMENTS

| | | | | | |
|---|---|---|---|---|---|
| 2,402,292 | A * | 6/1946 | Nichols | A41D 27/26 | 450/86 |
| 2,550,044 | A * | 4/1951 | Delsalle | A63B 71/12 | 2/462 |
| 2,957,177 | A * | 10/1960 | Turner | A63B 71/12 | 2/462 |
| 3,088,115 | A * | 5/1963 | Groot | A63B 71/12 | 2/462 |
| 3,144,657 | A * | 8/1964 | Groot | A63B 71/12 | 2/462 |

(Continued)

FOREIGN PATENT DOCUMENTS

| | | |
|---|---|---|
| DE | 202004013671 U1 | 12/2004 |
| DE | 202005005413 U1 | 2/2006 |

(Continued)

*Primary Examiner* — Amy Vanatta

(74) *Attorney, Agent, or Firm* — The Compton Law Firm, P.C.; Scott D. Compton

(57) ABSTRACT

The present application is directed to a wearable chest protector system operationally configured to affect substances located on one or more surfaces of interest. One suitable chest protector system is wearable for baseball purposes and includes a shoulder cap assembly constructed from one or more materials operationally configured to affect substances located on one or more surfaces of interest. The shoulder cap assembly may include one or more removable component parts.

18 Claims, 22 Drawing Sheets

(56) References Cited

U.S. PATENT DOCUMENTS

| | | | | |
|---|---|---|---|---|
| 3,760,461 | A | 9/1973 | Wright | |
| 4,502,156 | A | 3/1985 | Wishman | |
| 4,507,801 | A * | 4/1985 | Kavanagh | A41D 13/015 2/267 |
| 4,768,236 | A | 9/1988 | Klob | |
| 4,989,265 | A * | 2/1991 | Nipper | A41D 13/0518 2/267 |
| 4,993,076 | A | 2/1991 | Dierickx | |
| 5,014,360 | A * | 5/1991 | Smith | A41D 31/12 2/115 |
| 5,020,156 | A | 6/1991 | Neuhalfen | |
| 5,029,343 | A | 7/1991 | McIntyre | |
| 5,075,901 | A | 12/1991 | Vollrath | |
| 5,090,060 | A | 2/1992 | Gates | |
| 5,146,625 | A | 9/1992 | Steele et al. | |
| 5,189,738 | A * | 3/1993 | Mitchell | A41D 27/26 2/247 |
| 5,287,559 | A | 2/1994 | Christiansen et al. | |
| 5,553,326 | A | 9/1996 | Moore | |
| 5,706,521 | A | 1/1998 | Haney | |
| 6,003,190 | A | 12/1999 | Knudsen | |
| 6,298,496 | B1 | 10/2001 | Evans | |
| 6,519,782 | B2 | 2/2003 | Collins et al. | |
| 6,820,281 | B2 | 11/2004 | Mariland et al. | |
| 6,964,688 | B1 | 11/2005 | Kania | |
| 7,765,615 | B2 | 8/2010 | Eastwood et al. | |
| 8,931,112 | B1 | 1/2015 | Furst et al. | |
| 8,966,701 | B2 | 3/2015 | Dellecave et al. | |
| 10,646,769 | B1 * | 5/2020 | Farris | A41D 13/0015 |
| 2004/0031120 | A1 | 2/2004 | Cherian | |
| 2007/0050886 | A1 * | 3/2007 | Brassill | A63B 71/12 2/115 |
| 2008/0010721 | A1 | 1/2008 | Campbell et al. | |
| 2008/0104739 | A1 | 5/2008 | Kharazmi | |
| 2008/0190975 | A1 | 8/2008 | Naughton | |
| 2010/0064462 | A1 | 3/2010 | Lemler et al. | |
| 2010/0242158 | A1 * | 9/2010 | Blakely | A41D 13/0512 2/461 |
| 2012/0291177 | A1 | 11/2012 | Luscher | |
| 2013/0000024 | A1 | 1/2013 | Perreault | |
| 2013/0042380 | A1 | 2/2013 | Goodman | |
| 2013/0111645 | A1 * | 5/2013 | Dokhanian | A41D 31/12 2/69 |
| 2019/0116903 | A1 * | 4/2019 | Bourn | A63B 71/1225 |

FOREIGN PATENT DOCUMENTS

| | | | |
|---|---|---|---|
| GB | 2307843 | A | 11/1997 |
| JP | 2008075233 | A | 4/2008 |

* cited by examiner

WEARABLE DEVICES, ASSEMBLIES, SYSTEMS AND METHODS FOR TREATING SUBSTANCES ON SURFACES

CROSS-REFERENCE TO RELATED APPLICATIONS

This non-provisional patent application claims the benefit of and priority from U.S. provisional patent application No. 62/432,567 filed Dec. 11, 2016.

STATEMENT REGARDING FEDERALLY SPONSORED RESEARCH OR DEVELOPMENT

Not applicable.

FIELD OF THE APPLICATION

The application relates generally to the removal or collection of substances from surfaces.

BACKGROUND OF THE APPLICATION

Athletes typically apply towels and/or sweat bands to the head and face to absorb or wipe away moisture and sweat in order to try and keep such from rolling down the face and/or into the eyes. In other instances, athletes may use sports equipment and/or his/her uniform to absorb or wipe away moisture and sweat from the body. For example, baseball catchers often use the chest protector to displace sweat from their faces to minimize the amount of sweat that may get into their eyes and/or saturate their catcher masks and/or catcher helmets. In situations where the chest protector includes one or more shoulder caps, catchers may use the shoulder cap instead of the chest protector to displace sweat. As an extension to the chest protector, shoulder caps are similar in construction as the corresponding chest protector including internal padding and an external textile casing. Because the primary function of baseball catcher chest protectors and their shoulder caps is to provide protection against high impacts as well as abrasion resistance from moving baseballs, baseball bats, and contact with other players and physical objects such as a backstop and the playing surface when diving for baseballs, the focus of front outer surface chest protector and shoulder cap design is the strength and durability of the material(s) employed. In other words, baseball catcher chest protectors and shoulder caps are designed for protective purposes and the materials of construction have limited moisture absorption and/or wicking properties and are commonly abrasive, i.e., not soft, or otherwise uncomfortable to a person's skin depending on the make and model of chest protector and shoulder cap. As such, the ability to displace, remove or otherwise reduce moisture, sweat and other substances from target surfaces on a person's body is limited and/or uncomfortable to the touch. Overcoming such shortcomings is desired.

SUMMARY

In one aspect, the application is directed to a chest protector system including (1) a chest protector having a front outer surface and a back outer surface; and (2) a shoulder cap assembly attachable to the chest protector, the shoulder cap assembly having a front outer surface and a back outer surface; wherein the front outer surface of the chest protector is constructed from a first textile composition and the front outer surface of the shoulder cap assembly is constructed from a second textile composition, the first textile composition having a higher specific strength than the second textile composition.

In another aspect, the application is directed to a removable cover for a shoulder cap of a chest protector, the shoulder cap being characterized by a first maximum thickness, a first maximum weight and having a front outer surface constructed from a first textile composition having a first average denier count, a raised surface of a first depth and a first moisture regain, the removable cover including (1) a back surface; and (2) a front surface defined by a second textile composition having a second average denier count less than the first average denier count. In one suitable implementation, the second textile composition has a raised surface of a depth greater than the first depth of the first textile composition.

In still another aspect, the application is directed to a chest protector system including (1) a chest protector having a front outer surface and a back outer surface, wherein the front outer surface is defined by a first textile composition of a first average tenacity and a first average moisture regain; and (2) a shoulder cap assembly attachable to the chest protector, the shoulder cap having a front outer surface and a back outer surface, wherein the front outer surface is defined by a second textile composition of a second average tenacity less than the first average tenacity and a second average moisture regain greater than the first average moisture regain.

DETAILED DESCRIPTION

Figure 2:
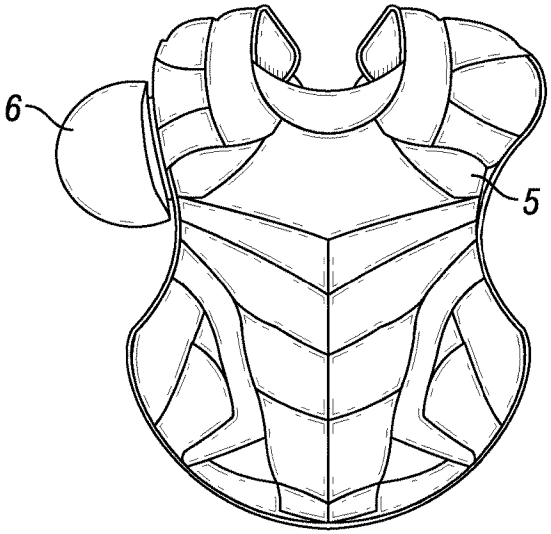
FIG. 2 is a front view of another common chest protector including a shoulder cap corresponding to the right shoulder of a person to wear the chest protector.

Before describing the invention in detail, it is to be understood that the present invention is not limited to any particular embodiment. It is also to be understood that the terminology used herein is for the purpose of describing particular embodiments only, and is not intended to be limiting. As used in this specification and appended claims, the terms "baseball" and "softball" may be used interchangeably including, but not limited the catcher position and/or a catcher's chest protector equipment as such are understood by the skilled artisan in the games of baseball and softball. Also, the phrase "baseball chest protector" may also be used interchangeably with the phrase "softball chest protector." However, the term "chest protector" is not limited to chest protector equipment meant for baseball or softball use, but rather refers to one or more devices worn along the front of a person's torso for protecting, for example, the chest, abdomen and clavicle regions of the torso. For purposes of this application, the term "catcher" and "baseball chest protector" may also include baseball umpires and chest protectors worn by baseball umpires, as well as chest protectors worn in other sports and other physical activities. As understood by the skilled artisan, the position of catcher in the game of baseball is the individual game player positioned or otherwise located in the catcher's box for receiving pitches from a pitcher, for example, see Rule 2.01 of the Major League Baseball Official Baseball Rules, 2017 Edition, ISBN 978-0-9961140-4-2 herein incorporated by reference in its entirety. In regard to the game of baseball, the phrases "competitive level" and "organized level" refer to professional baseball, semi-professional baseball, and amateur baseball such as the collegiate level, high school level, select, little league, pony league and other youth leagues as the names of such are subject to change and vary from state to state and country to country.

It has been discovered that a shoulder cap portion or shoulder cap assembly of a baseball chest protector may be configured to affect or treat one or more substances including, but not necessarily limited to undesired and/or superfluous substances, present on one or more particular surfaces of interest. For purposes of this application, the treatment of one or more substances or the "treating" of one or more substances found on one or more particular surfaces comprises contacting at least part of an external surface of a shoulder cap portion of a shoulder cap assembly against one or more target surfaces where one or more target substances are located for the purpose of accomplishing one or more of the following acts: absorb, wick, collect, transfer, displace, expel, clean, sanitize, diminish, separate, spread, extract, delete, eliminate, and combinations thereof the one or more target substances, or a portion thereof, in relation to the one or more target surfaces where the one or more target substances is originally located. The aforementioned acts may also be referred to herein collectively as "treating a surface" or "treating a target surface." The phrases "close-fit," "close-fitting" and like terms may be used interchangeably with the term "skintight," "form fit," and "form fitting." As understood by the skilled artisan, the surface area of a fabric is directly related to the denier and cross-sectional shape of the fibers in the fabric. Smaller deniers yield more fibers per unit weight of the material and higher total fiber surface area. As also understood by the skilled artisan, the phrase "specific strength" refers to a material's strength (force per unit area at failure) divided by its density. Specific strength is also known as the strength-to-weight ratio or strength/weight ratio. In fiber or textile applications, the term "tenacity" is the usual measure of specific strength. The SI unit for specific strength is Pa $m^3$/kg. A "denier" is a unit of measure for the linear mass density of fibers—it is the mass in grams per 9000.00 meters of the fiber. For purposes herein, "compressible" is defined as the ability of a textile material, or other material, to be compressed from a relatively larger, expanded configuration to a relatively smaller, compressed configuration. In reference to textile fibers, the term "resilient" is defined as the ability of a textile material to recover from a compressed configuration to substantially its original shape, structure and dimensions as in the non-compressed configuration. In reference to textile fibers, the term "elastic" is defined as having the property of generally returning to an original length, size or shape after stretching. "Elastic recovery" is the percentage of return toward the original length. If a textile fiber returns to its original length, the fiber is said to have one hundred percent (100%) elastic recovery. Herein, the amount of stretch or extension that textile fibers will accept is referred to as "elongation."

Without limiting the scope of the invention, foreseeable target substances may include, but are not necessarily limited to fluids, soils, soaps and soap scum, deodorant residue, acids, cosmetics, physical materials and/or objects, insects, foods, food condiments, waxes, black tars, pine tars, rosins, chalks, powders, inks, dyes, adhesives, ice, pastes including but not limited to toothpaste, water and oil based paints, topical medicinal agents, water based ointments, oil based ointments, e.g., petroleum jelly and the like, zinc oxide, water based lubricants, oil based lubricants, chewing gum, human tissue matter, e.g., hair, skin, dead skin, scabs, eye lashes, plant material, and combinations thereof. In regard to the game of baseball, one or more target surfaces may include, but are not necessarily limited to human skin, human hair, jewelry, clothing, uniforms, wrist bands, wrist wraps, eyewear, e.g., glasses, goggles, sun shades, flip-up shades, apparel, shoes, sports equipment, baseball equipment, baseball catching equipment, player and/or groundskeeper machinery or equipment, and other surfaces that may be encountered at a baseball field, facility, stadium, and combinations thereof. Suitable baseball equipment may include, but is not necessarily limited to baseballs, fielding gloves, batting gloves, hats, bats, helmets, bat donuts, stop watches, clip boards, paper, paper items, and combinations thereof. Suitable baseball catching equipment may include, but is not necessarily limited to masks, neck guards, shin guards, wrist guards, elbow guards, finger guards, hand guards, chest protectors, and combinations thereof. Suitable player machinery or equipment may include, but is not necessarily limited to video equipment, batting cage surfaces, baseball training equipment such as pitching machines, batting tees, exercise equipment, rehabilitation equipment, and combinations thereof. Suitable groundskeeper machinery or equipment may include, but is not necessarily limited to hand tools, dry line marks, drag mats, hoses, field covers, tarps, tractors, bagged items, and combinations thereof. Suitable hand tools may include, but are not necessarily limited to rakes, brooms, tamps, shovels, paint brushes, paint rollers, and combinations thereof. Other surfaces herein contemplated may include, but are not necessarily limited to benches, chairs, stools, steps, railing, stools, located in dugouts and/or bullpens, grand stand seating and other grand stand surfaces, press box seating and other press box surfaces, surfaces located underneath the grand stands or bleachers, on-deck circle surfaces, pine tar rags, pitcher plates (often referred to as pitching "rubbers") first base, second base, third base, outfield walls, out-of-bounds wall surfaces, golf carts and other on-field vehicles, walkway surfaces, e.g., walls, restroom surfaces, shower surfaces, water fountain surfaces, water cooler surfaces, ice machine surfaces, washer/dryer surfaces, and combinations thereof. Other target surfaces are herein contemplated, including, but not necessarily limited to eating utensil surfaces, food plate surfaces, food and/or beverage container surfaces, chalk board surfaces, dry erasure board surfaces, mirrors, windows, light switches, light fixtures, walls, doors, door handles, soda machines, arcade style video games, home type video game consoles, televisions, payphones, office phones, billiard sticks, billiard tables, billiard balls, ping pong tables, ping pong balls, ping pong paddles, foosball tables, medical type training tables, crutches, hygiene and/or grooming product containers, medicinal containers, and combinations thereof.

Herein, the term "fluid" refers to those substances capable of flowing and changing shape such as liquids. For purposes of this application, liquids may include, but are not necessarily limited to (1) mammalian body fluids including, but not necessarily limited to sweat, tears, vomit, urine, blood, blood serum, earwax, feces, female ejaculate, vaginal secretion, gastric acid, mucus, saliva, spit, sebum, semen, and combinations thereof, (2) oils, (3) honey, (4) aqueous solutions such as hydrogen peroxide, salt water, sugar containing solutions, electrolyte containing solutions, ammonia water, and combinations thereof, (5) solvents such as water, methanol, ethanol, propanol, n-butanol, iso-butanol, 2-butanol, acetic acid, hexanol, pentanol, 2-methyl-1-butanol, methoxymethanol, methoxyethanol, hexane, cyclohexane, octanol, nonanol, decanol, acetone, chloroform, toluene, benzene, diethyl ether, methoxy propanol, and combinations thereof, (6) topical mixtures such as foams, creams, gels, sprays, sun screen, ear drops, eye drops, hair cream, hair gel, liquid based ointments, oil based ointments, e.g., antibacterial ointments, and combinations thereof, (8) beverages, (9) soap bubbles, (10) tobacco/saliva mixtures, (11) tree sap, (12) liquid chemicals, and combinations thereof. Herein, the term "water" may include, but is not necessarily limited to drinking water, melting ice, melting sleet, melting snow, perspiration, i.e., sweat, hose water, sprinkler water, tub water, bath water, shower water, pool water, whirlpool water, condensation, precipitation, and combinations thereof.

Herein, the term "soil" may refer to earth matter including any and all minerals, clay, dirt, mud, silt, ash, dust, sand, and combinations thereof. The term "cosmetics" may include, but is not necessarily limited to lipstick, lip balm, mascara, eye shadow, foundation, rouge, skin cleansers, skin lotions, skin gels, skin greases, eye black, and combinations thereof. Physical objects may include foreign items or unwanted items that may be located on one or more target surfaces. In baseball type settings, typical solid or physical materials and/or objects may include, but are not necessarily limited to natural grass, chalk, dirt, leaves, pollen, chewing gum, chewing gum wrappers, candy, candy residue, candy wrappers, sunflower seeds, insects, rodent droppings, bird droppings, tobacco leaves including ground tobacco, artificial field turf, thread, wood materials including, for example, sawdust, splinters, shards of wood, and combinations thereof, metal materials such as shards of metal, polymeric materials such as shards of plastic, adhesive tape, pieces of paper like baseball fan waist items, confetti, streamers, crumb rubber, sweat stains on caps, and combinations thereof.

Herein, the terms "absorb," "absorbance" and like terms refer to the process by which a material takes up a fluid. The terms "wick," "wicking," "wickability" and the like refer to the movement of fluid along or between fibers of a textile material or fabric. The term "terry" and "terrycloth" may be used interchangeably to refer to a pile fabric with uncut loops on both sides as understood by the skilled artisan. Herein, a "microfiber" refers to a fiber finer than one denier, and may also referred to herein as "microfiber denier." The phrase "double rub" or "double rubs" refers to a measurement of a textile's abrasion resistance. As understood by the skilled artisan, double rubs are found through a mechanized test called the "Wyzenbeek Test" (sometimes called the Wyzenbeek Method), which is described in U.S. Pat. No. 4,941,884, published Jul. 17, 1990, titled "Comfortable Fabrics of High Durability," which is incorporated herein by reference in its entirety. Descriptions regarding a "Determination of Fabric Tightness" and a "Determination of Fiber Tightness" are also described in U.S. Pat. No. 4,941,884 and incorporated by reference herein in its entirety. The "Martindale" is a unit for quantifying the abrasion resistance of textiles. Known by skilled artisans as the "Martindale test," "Martindale method" or the "Martindale rub test," test results are used to check the durability of a textile.

In one aspect, the application provides a chest protector system including a shoulder cap assembly for a chest protector that is operationally configured to treat one or more target substances located on one or more target surfaces. The shoulder cap assembly may be releasably attached from a chest protector or permanently attachable thereto. The shoulder cap assembly may be assembled together from two or more individual component parts or provided as a one-piece construction. In one embodiment, a shoulder cap assembly may be assembled for permanent assembly. In another embodiment, a shoulder cap assembly may be disassembled into its two or more individual component parts. In one embodiment, the chest protector and shoulder cap assembly may include one or more impact resistant base members enclosed within one or more textile materials. Suitable base member materials of construction may include, but are not necessarily limited to metals, polymeric materials, e.g., plastics and rubbers, and combinations thereof. One suitable base member material of construction may include ethylene vinyl acetate foam material. Another suitable base member material of construction may include memory foam. Combinations of the above is also contemplated.

In another aspect, the application provides a shoulder cap assembly or configuration intended for a baseball catcher's chest protector that is operationally configured to treat one or more target substances located on one or more target surfaces.

In another aspect, the application provides a chest protector system including a chest protector having a front surface or front outer surface constructed from one or more materials including, but not necessarily limited to one or more textile compositions and at least one shoulder cap assembly attachable to the chest protector, wherein the shoulder cap assembly includes (1) an inner base member having an outer surface defining the outer ornamental shape or form of the inner base member and (2) a removable member operationally configured to envelope or cover at least part of the base member. The removable member is suitably constructed from one or more materials operationally configured to contour the outer surface of the inner base member when assembled. In another implementation, an inner base member may be comprised of two or more individual component members of the same and/or different materials of construction.

In another aspect, the application provides a chest protector system including (1) a chest protector having a front outer surface constructed from one or more textile compositions and (2) at least one shoulder cap assembly attached thereto, the shoulder cap assembly having a front outer surface constructed from one or more textile compositions operationally configured to treat moisture on surface(s) more effectively than the one or more textile compositions comprising the front outer surface of its corresponding chest protector. In one embodiment, the front outer surface of the shoulder cap assembly is constructed from one or more materials operationally configured to treat moisture on surface(s) more effectively than the one or more textile compositions comprising the front outer surface of its corresponding chest protector by at least a factor of about 1.5 or more; in another embodiment, by at least a factor of about 8.0 or more; in another embodiment, by at least a factor of about 10.0 or more; in another embodiment, by at least a factor of about 18.0 or more; in another embodiment, at least by a factor of about 25.0 or more.

In another aspect, the application provides a chest protector including a shoulder cap attached thereto, the shoulder cap having a front outer surface constructed from one or more materials providing a greater rate of absorption than the materials of construction of the front outer surface of its corresponding chest protector; in one embodiment, by at least a factor of about 1.5 or more; in another embodiment, by at least a factor of about 8.0 or more; in another embodiment, by at least a factor of about 10.0 or more; in another embodiment, by at least a factor of about 18.0 or more; in another embodiment, by at least a factor of about 25.0 or more.

In another aspect, the application provides a chest protector including a shoulder cap assembly attached thereto, the shoulder cap assembly having a front outer surface constructed from one or more materials providing greater wickability than the materials of construction of the front outer surface of its corresponding chest protector; in one embodiment, by at least a factor of about 1.5 or more; in another embodiment, by at least a factor of about 8.0 or more; in another embodiment, by at least a factor of about 10.0 or more; in another embodiment, by at least a factor of about 18.0 or more; in another embodiment, by at least a factor of about 25.0 or more.

In another aspect, the application provides a chest protector system including a chest protector with a front outer surface constructed from one or more textile materials providing a first textile composition of the system. The system also includes a shoulder cap assembly attachable to the chest protector, the shoulder cap assembly having a front outer surface constructed from one or more textile materials providing a second textile composition of the system. The second textile composition includes a greater rate of absorption and/or greater wickability than the first textile composition. In addition, the first textile composition has a double rub count greater than the second textile composition.

In another aspect, the application provides a chest protector system including a chest protector and a shoulder cap assembly attachable thereto, the shoulder cap assembly being operationally configured to be extended out from a first resting position to one or more second extended positions and returned to the first position as desired. The shoulder cap assembly is suitably constructed from one or more materials operationally configured to treat one or more target substances located on one or more target surfaces.

In another aspect, the application provides a shoulder cap assembly for a baseball catcher chest protector, the shoulder cap being constructed from one or more materials operationally configured to treat one or more target substances located on one or more target surfaces more efficiently than the one or more materials of construction of the chest protector.

In another aspect, the application provides a chest protector system including a shoulder cap assembly attachable thereto, the shoulder cap assembly having one or more outer surfaces operationally configured to treat one or more target substances located on one or more target surfaces.

In another aspect, the application provides a shoulder cap assembly for a baseball catcher chest protector the shoulder cap assembly including a removable and/or interchangeable member operationally configured to treat one or more target substances located on one or more target surfaces.

In another aspect, the application provides a shoulder cap system for a baseball catcher chest protector including a removable and/or interchangeable member providing one or more outer surfaces of a shoulder cap for treating one or more target substances located on one or more target surfaces, such member being constructed from one or more materials effective to treat the target substances.

In another aspect, the application provides a substance treatment member removably attachable to a shoulder cap of a baseball catcher chest protector, the shoulder cap having an outer casing defined by a textile composition of one or more textile fibers. In one embodiment, the substance treatment member may be constructed from a textile composition of one or more textile fibers having a breaking strength less than the breaking strength of the one or more textile fibers defining the outer casing including, but not necessarily limited to a front outer surface of the outer casing.

In another aspect, the application provides a baseball catcher chest protector including a shoulder cap assembly with a substance treatment member releasably attachable thereto. The substance treatment member is constructed from one or more materials operationally configured to collect one or more target substances from one or more target surfaces more effectively than the materials of construction of the shoulder cap assembly.

In another aspect, the application provides a fluid collection member removably attachable to a shoulder cap of a baseball catcher chest protector. In another aspect, the application provides a fluid collection member operationally configured for permanent attachment to a shoulder cap of a baseball chest protector providing an embodiment of a shoulder cap assembly. In another aspect, the application provides a textile based fluid collection member removably attachable to a shoulder cap of a baseball chest protector. In another aspect, the application provides a textile fluid collection member operationally configured for permanent attachment to a shoulder cap of a baseball catcher chest protector.

In another aspect, the application provides a substance treatment member removably attachable to a baseball catcher chest protector. In another aspect, the application provides a moisture absorption member removably attachable to a shoulder cap of a baseball catcher chest protector. In another aspect, the application provides a substance treatment member with a textile outer surface removably attachable to a baseball catcher chest protector. In another aspect, the application provides a moisture absorption member with a textile outer surface removably attachable to a shoulder cap of a baseball catcher chest protector.

In another aspect, the application provides a baseball catcher chest protector shoulder cap constructed from one or more substance treating materials as described herein. The one or more substance treating materials may exhibit no swelling or minimal swelling when contacting fluid or when otherwise exposed to moisture.

In another aspect, the application provides a slip-on cover type removable member constructed from one or more materials effective for treating one or more target substances on one or more target surfaces, the slip-on cover being operationally configured to enclose or envelope all or part of a shoulder cap of a baseball catcher chest protector in a close-fitting manner regardless the shape or outer surface configuration of the shoulder cap. In another embodiment, the slip-on cover is operationally configured to envelope all or part of a shoulder cap of a baseball catcher chest protector and form a close-fit along the front outer surface of the shoulder cap. In another aspect, a slip-on cover type substance treatment member may be operationally configured for use with a bill of a baseball style cap and/or helmet as understood by the skilled artisan. One suitable slip-on cover may be disposable and replaced by another slip-on cover. Another suitable slip-on cover may be reusable and machine washable similar as other textiles and clothing. As such, a shoulder cap may make use of a clean or new slip-on cover as desired. In addition, a slip-on cover constructed from one or more textile materials may be repaired similar as clothing via sewing and/or patching and/or gluing tears, rips, holes, and the like.

In another aspect, the application provides a removable substance treatment member in the form of a slip-on cover that is operationally configured to envelope a shoulder cap of a baseball chest protector in a close-fitting manner regardless the shape or outer surface configuration of the shoulder cap, the slip-on cover being operationally configured to shield or protect the shoulder cap located therein from soil, liquids, moisture, chemicals, and ambient environmental influences such as ultra-violet radiation. Even though commercially available shoulder caps may be hand washable and/or machine washable, such activities may compromise the quality and/or functionality of a shoulder cap over time. Suitably, a slip-on cover of this application is operationally configured to be (1) removed from a shoulder cap and hand washed and/or machine washed for reuse and/or (2) removed from a shoulder cap and replaced with another slip-on cover as desired.

In another aspect, the application provides a slip-on cover type of substance treatment member that is operationally configured to envelope a shoulder cap of a baseball chest protector in a close-fitting manner regardless the shape or outer surface configuration of the shoulder cap, the substance treatment member being effective to collect one or more target substances from one or more target surfaces described above.

In another aspect, the application provides a substance treatment member operationally configured to hold one or more substances along its outer surface including, but not necessarily limited to water-based lubricants, oil-based lubricants such as petroleum jelly and vitamin E oil, pine tar and other tacky substances for transfer onto a baseball for a pitcher's use thereof. A substance treatment member of this application may also include one or more abrasive surfaces including one or more baseball scuffing materials. In an embodiment including a slip-on cover type of substance treatment member, the slip-on cover may operate has a pouch or pocket for holding one or more items when attached to a base member or shoulder cap or as a separate carriable device, e.g., money, credit cards, keys, gum, paper, written scouting reports on paper regarding the opposing team players, scuffing materials such as sand paper, chap stick, sunblock, mouth guards, nose strips, bandages, tape, eye black, and baseball game sign signal enhancement stickers for the fingers of a throwing hand of a catcher.

In another aspect, the application provides a chest protector system including (1) a baseball catcher chest protector defined by a front outer surface and (2) one or more shoulder caps permanently attached or releasably attachable thereto, the one or more shoulder caps being defined by front outer surfaces. In one embodiment of the system, the front outer surfaces of the chest protector and one or more shoulder caps may be constructed from the same or substantially similar material(s). The system may include one or more slip-on cover members operationally configured to envelope a corresponding shoulder cap in a manner effective to remain in an enveloped position about the corresponding shoulder cap during system operation. In one embodiment, the one or more slip-on cover members may be constructed from one or more materials effective to provide a front outer surface of the one or more shoulder caps different than the one or more materials of construction defining the front outer surface of the chest protector. In another embodiment, the one or more slip-on cover members may be constructed from a plurality of materials effective to provide a front outer surface of the one or more shoulder caps materially similar as the front outer surface of the chest protector wherein the materials defining the one or more slip-on cover members are provided in a different ratio of the total material composition compared to the materials defining the front outer surface of the chest protector. In another embodiment, the one or more slip-on cover members may be constructed from one or more textile materials effective to provide a front outer surface of the shoulder caps, the one or more textile materials of the slip-on cover members including at least one fiber type also present in the one or more materials of the front outer surface of the chest protector, the one or more textile materials of the slip-on cover members having a weight different than the one or more materials defining the front outer surface of the chest protector.

In another aspect, the application provides a chest protector system including a chest protector having a front outer surface and one or more shoulder caps attached thereto, the one or more shoulder caps each having a front outer surface. The front outer surface of the chest protector is constructed from a textile composition different from the textile composition comprising the front outer surface of the one or more shoulder caps. In one embodiment, the textile composition comprising the front outer surface of the one or more shoulder caps is softer than the textile composition comprising the front outer surface of the chest protector. In another embodiment, the one or more textiles comprising the front outer surface of the one or more shoulder caps has a greater surface area per square meter than the one or more textiles comprising the front outer surface of the chest protector.

In another aspect, the application provides a chest protector system including (1) a chest protector having a front surface constructed from one or more textiles and (2) at least one shoulder cap attached thereto, the shoulder cap having a front surface constructed from one or more textiles the same or substantially similar as the chest protector. The chest protector system further includes one or more slip-on cover members operationally configured to cover the front surface of the shoulder cap during system use. As such, the front surface of the shoulder cap is not visible during system use. The slip-on cover may be removable or permanently secured to the shoulder cap.

In another aspect, the application provides a chest protector system including (1) a chest protector having a front outer surface constructed from one or more textiles and (2) a shoulder cap assembly attachable thereto, the shoulder cap assembly having a front outer surface constructed from one or more textiles, wherein the one or more textiles defining the front outer surface of the chest protector have a greater tightness than the one or more textiles defining the front outer surface of the shoulder cap assembly.

In another aspect, the application provides a chest protector system including (1) a chest protector having a front outer surface constructed from one or more textiles and (2) at least one shoulder cap assembly attached thereto, the shoulder cap assembly having a front outer surface constructed from one or more textiles. The one or more textiles defining the front outer surface of the chest protector include fibers having a greater tightness than the fibers of the one or more textiles defining the front outer surface of the shoulder cap assembly.

In another aspect, the application provides a chest protector system including (1) a chest protector having a front outer surface constructed from one or more fabrics and (2) at least one shoulder cap assembly attached thereto, the shoulder cap assembly having a front outer surface constructed from one or more fabrics. In an embodiment wherein the one or more fabrics defining the front outer surface of the chest protector and the shoulder cap assembly are the same or substantially similar in construction, the individual fibers of the chest protector fabric(s) are thicker than the individual fibers of the shoulder cap assembly fabric(s).

In another aspect, the application is directed to a chest protector system including a chest protector and at least one shoulder cap assembly attached thereto or releasably attachable thereto, the shoulder cap assembly including a base member and a removable treatment member for releasably covering at least part of a front surface of the base member. In a first instance, the base member is defined by a maximum thickness at one or more points along the base member. When the treatment member is attached to the base member or shoulder cap, the maximum thickness of the shoulder cap assembly may range from about 0.25 percent (0.25%) to about 25.0 percent (25.0%) greater in thickness than the maximum thickness of the base member alone. In another embodiment, the maximum thickness of the shoulder cap assembly may range from about 0.25 percent (0.25%) to about 20.0 percent (20.0%) greater in thickness than the maximum thickness of the base member. In another embodiment, the maximum thickness of the shoulder cap assembly may range from about 0.25 percent (0.25%) to about 10.0 percent (10.0%) greater in thickness than the thickness of the base member alone. In another embodiment, the maximum thickness of the shoulder cap assembly is about 20.0 percent (20.0%) greater in thickness than the thickness of the base member. In another embodiment, the maximum thickness of the shoulder cap assembly is about 15.0 percent (15.0%) greater in thickness than the thickness of the base member. In another embodiment, the maximum thickness of the shoulder cap assembly is about 10.0 percent (10.0%) greater in thickness than the thickness of the base member. In another embodiment, the maximum thickness of the shoulder cap assembly is about 5.0 percent (5.0%) greater in thickness than the thickness of the base member. In a second regard, a base member has a maximum weight. In one embodiment, when the removable treatment member is attached to the base member, the shoulder cap assembly may include a maximum weight up to about 40.0 percent (40.0%) greater than the maximum weight of the base member. In another embodiment, the shoulder cap assembly may include a maximum weight up to about 30.0 percent (30.0%) greater than the maximum weight of the base member. In another embodiment, the shoulder cap assembly may include a maximum weight up to about 20.0 percent (20.0%) greater than the maximum weight of the base member. In another embodiment, the shoulder cap assembly may include a maximum weight up to about 10.0 percent (10.0%) greater than the maximum weight of the base member. In another embodiment, the shoulder cap assembly may include a maximum weight up to about 5.0 percent (5.0%) greater than the maximum weight of the base member. In another embodiment, the shoulder cap assembly may include a maximum weight ranging from about 1.0 percent (1.0%) to about 5.0 percent (5.0%) greater than the maximum weight of the base member.

In another aspect, the application is directed to a chest protector system including (1) a chest protector and (2) at least one shoulder cap assembly attached thereto or releasably attachable thereto, the shoulder cap assembly including (a) a base member with (b) one or more attachment members attached to the base member for attaching the shoulder cap assembly to the chest protector, and (c) a removable treatment member for releasably covering at least part of a front surface of the base member, wherein the removable treatment member is operationally configured to releasably attach to the base member unencumbered by the one or more attachment members. For example, the removable member may be operationally configured to releasably attach to the base member without necessarily contacting the one or more attachment members.

In another aspect, the application is directed to a chest protector system including a chest protector and at least one shoulder cap assembly permanently attached or releasably attachable thereto, the shoulder cap assembly including a base member in the form of a shoulder cap, one or more attachment members attached to the base member and a removable treatment member for releasably covering at least part of a front surface of the base member. The base member includes a front outer surface comprised of one or more textiles with fibers within a particular denier range. In one embodiment, the removable treatment member may be comprised of one or more textiles similar as the base member, the one or more textiles of the removable treatment member having fibers outside of or in a range different than the denier range of the base member fibers. In another embodiment, the one or more textiles of the removable treatment member have fibers of a denier range different from the denier range of the base member fibers.

In another aspect, the application is directed to a chest protector system including a chest protector and at least one shoulder cap assembly attached thereto or releasably attachable thereto, the shoulder cap assembly including a base member, one or more attachment members attached to the base member and a removable treatment member for releasably covering at least part of a front surface of the base member. The front outer surface of the chest protector is constructed from one or more textile materials including one or more ballistic fabrics or a satin weave, including but necessarily limited to polyester satin, nylon satin, and combinations thereof. The removable treatment member is constructed from one or more textile materials different than the one or more textile materials defining the front outer surface of the chest protector.

In another aspect, the application is directed to a chest protector system including a chest protector and a shoulder cap assembly releasably attachable to the chest protector. The chest protector includes an outer casing with a front outer surface constructed from a satin weave. The shoulder cap assembly includes an outer casing with a front outer surface constructed from one or more textiles different than the satin weave defining the front outer surface of the chest protector.

In another aspect, the application provides a shoulder cap assembly for a baseball catcher chest protector. The chest protector suitably includes a front outer surface defined by a first textile composition. The shoulder cap assembly has a front outer surface defined by a second textile composition operationally configured to treat one or more target substances located on one or more target surfaces wherein the second textile composition is less durable than the first textile composition according to results of the Wyzenbeek Test and/or the Martindale Test.

In another aspect, the application provides a substance treatment member operationally configured to be removably secured to a shoulder cap of a chest protector. In its resting position apart from the shoulder cap the substance treatment member has a perimeter defined by one or more bends corresponding to one or more bends of a perimeter of a corresponding shoulder cap, the corresponding bends having substantially similar radii of curvature.

Figure 1:
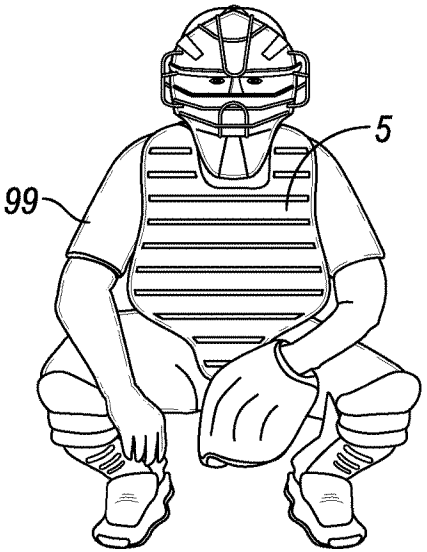
FIG. 1 is a simplified illustration of a common baseball catcher wearing catching equipment including a chest protector.

With attention to FIG. 1, a traditional baseball and/or softball catcher's chest protector 5 includes an outer fabric layer covering impact-absorbent or shock-absorbent padded members, e.g., foam, that is worn in front of the torso of a baseball catcher 99 via adjustable straps to protect the chest, abdomen and clavicle regions of the individual's torso against impacts suffered via contact with other persons, contact with moving baseballs such as thrown and batted baseballs including baseballs that are foul tipped toward a catcher during a batter's swing. The padded members and outer fabric layers are typically molded together to provide a rigid outer surface. Over time, a shoulder cap 6 (also commonly referred to as a "shoulder pad" or "shoulder guard") was developed to provide additional protective covering to the shoulder region—see FIG. 2, which depicts a single shoulder cap 6 for a right shoulder. In the alternative, some chest protectors 5 make include two shoulder caps 6 for each of the right and left shoulders as shown in FIG. 3. In some commercially available models shoulder caps 6 may be removably attachable to the chest protector 5 as desired, e.g., via one or more hook and loop fasteners, snap(s), hook(s), button(s), string(s), adhesive(s), and combinations thereof. Often times where a chest protector 5 is provided with two shoulder caps 6 as shown in FIG. 3, a catcher 99 may remove one of the shoulder caps, e.g., the shoulder cap 6 covering the throwing shoulder, for purposes of comfort and/or enhanced catching performance, or vice versa. In some commercially available models, chest protectors 5 may be provided with either one or two shoulder caps 6 as integral non-removable parts of the chest protector 5. In some commercially available models, chest protectors 5 may be provided with two identical or "universal" shoulder caps 6 for covering the right and left shoulder regions. In other commercially available models, chest protectors 5 may be provided with shoulder caps 6, each designed for exclusive use along either the right shoulder region or the left shoulder region. In such embodiment, the opposing shoulder caps 6 may be provided as mirror opposites. In another embodiment, the opposing shoulder caps 6 may be provided in distinct sizes and shapes, e.g., a smaller shoulder cap 6 may be used with the shoulder corresponding to the throwing arm of the catcher 99 using the chest protector 5. Moreover, one or more shoulder caps 6 originating from one commercial source may be used with a chest protector 5 originating from a different commercial source. Without limiting the present invention to any particular embodiment, for better understanding of chest protectors 5 generally, examples of catcher chest protectors 5 including a shoulder cap 6 corresponding to a user's throwing shoulder are described in U.S. Pat. No. 5,020,156, published Jun. 4, 1991, titled "Baseball Catcher's Chest Protector," and U.S. Pat. No. 7,900,283, published Mar. 8, 2011, titled "Chest Protector for Baseball Game," each of which is incorporated by reference in its entirety.

Figure 4:
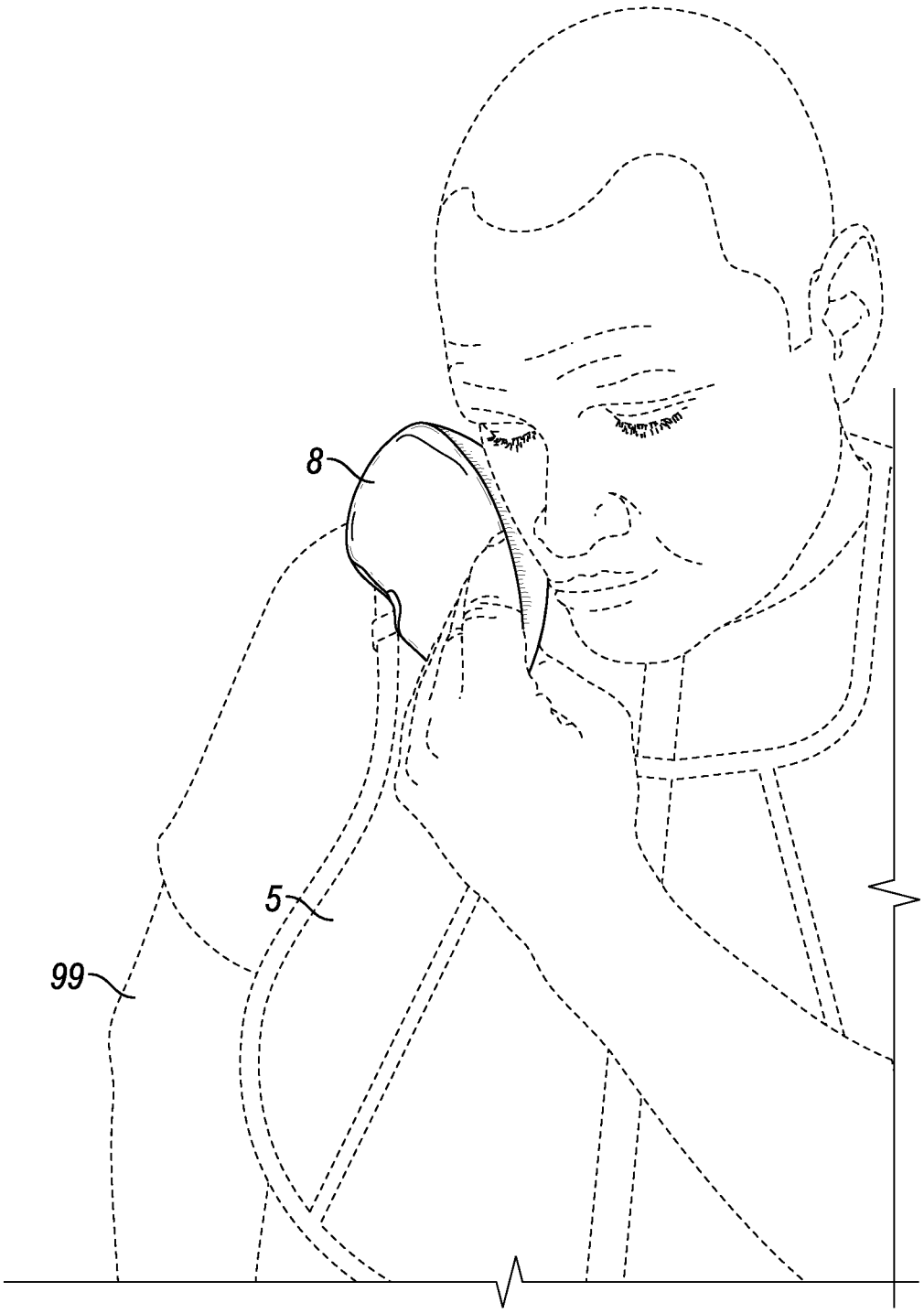
FIG. 4 is a simplified illustration of a baseball catcher touching his face with a shoulder cap of a chest protector.

As depicted herein, a common shoulder cap 6 is suitably located along the upper side edge of a chest protector 5 in a shape, size and form for protecting the front side of the corresponding shoulder area(s) of a catcher 99. The "shoulder area" or "shoulder region" of a catcher 99 may be defined as the deltoid muscle area forming the rounded contour of a shoulder. Even though a shoulder cap 6 may be built to scale, the maximum surface area of a suitable shoulder cap 6 typically provides coverage of the deltoid muscle area of a target catcher 99, be it an adult male, adult female, teenager or child, without encumbering the catcher's 99 ability to perform the game playing task required of a catcher 99 or "hind catcher" as the phrase is understood by the skilled artisan. Without limiting the present invention to any one particular mode of operation, the treatment of one or more target substances is discussed in terms of a shoulder cap assembly 8 and/or any portion of a chest protector 5 covering the deltoid muscle area of a catcher 99 that comprises one or more materials effective to treat target substances. In one non-limiting example of basic baseball catcher 99 operation, the treatment of one or more target substances may include the act of a catcher 99 wiping off substances such as dirt and sweat from his/her face with a front outer surface of a shoulder cap assembly 8 as shown in FIG. 4.

Figure 3:
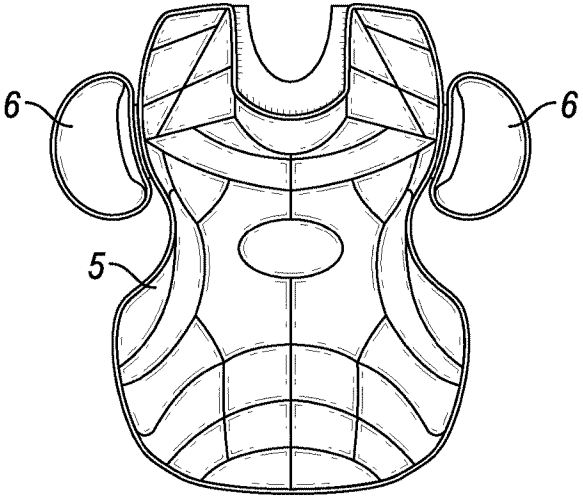
FIG. 3 is a front view of another common chest protector including a shoulder cap corresponding to each of the right and left shoulders of a person to wear the chest protector.
Figure 5:
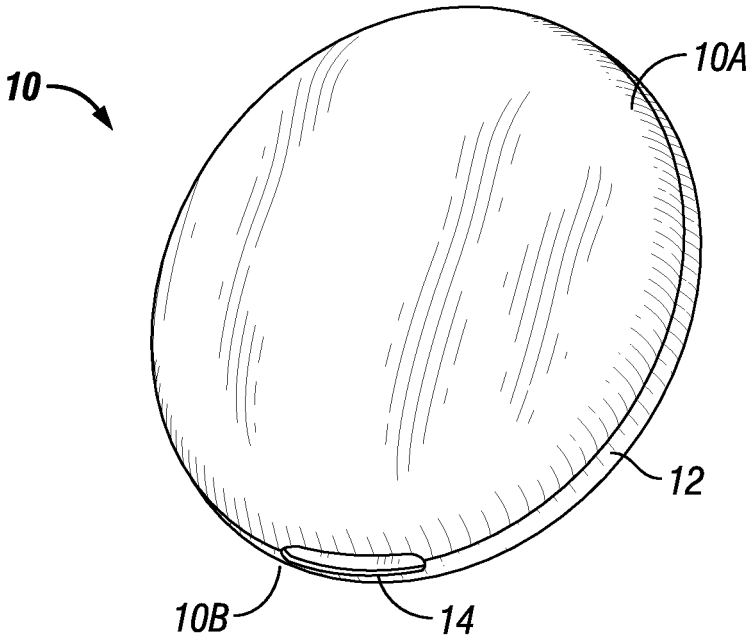
FIG. 5 is a perspective view of a simplified embodiment of a substance treatment member of this application.

Turning to FIG. 5, one shoulder cap assembly 8 of this application may include (1) a base member or shoulder cap 6 as shown in FIG. 2 and (2) an outer removable member in the form of a one-piece substance treatment member 10 (hereafter "treatment member 10") provided as a removable slip-on cover member operationally configured to envelope a base member or shoulder cap 6 in a manner effective to cover at least all or substantially all of a front surface of the base member or shoulder cap 6. In the embodiment of FIG. 5, the treatment member 10 has a front surface member defining a front surface 10A and a back surface member defining a back surface 10B. When assembled, the front surface 10A of this embodiment covers a front surface of a base member or shoulder cap 6 and the back surface 10B covers an opposing back surface of the base member or shoulder cap 6, or vice versa as desired.

A slip-on treatment member 10 as shown in FIG. 5 may be provided as a "one size fits all" construction effective to accommodate a plurality of base members or shoulder caps 6 of various shapes and/or sizes—examples of commercially available shoulder caps 6 are provided in FIGS. 2-3, 15, 23 and 31-42). In other words, when the treatment member 10 is in a resting position apart from a target base member or shoulder cap 6 the treatment member 10 may have a perimeter shape different than the perimeter shape of the target base member or shoulder cap 6. In one embodiment, the treatment member 10 may envelope a shoulder cap 6 in a close-fitting form according to the surface configuration of the corresponding shoulder cap 6. In another embodiment, the treatment member 10 may envelope a shoulder cap 6 in a loose manner. In another embodiment, the treatment member 10 may envelope part of a shoulder cap 6 in a close-fitting form, e.g., close-fit the front surface of a shoulder cap 6. Herein, the ability of a treatment member 10 to provide a close-fitting "one size fits all" form about a plurality of commercially available shoulder caps 6 may be referred to as being "shape adaptive." In addition to being shape adaptive, another advantage of the treatment member 10 of FIG. 5 is its nominal size and/or weight, which allows for shoulder cap assembly 8 operation similar as the operation of a standalone shoulder cap 6 for the same chest protector 5.

Figure 7:
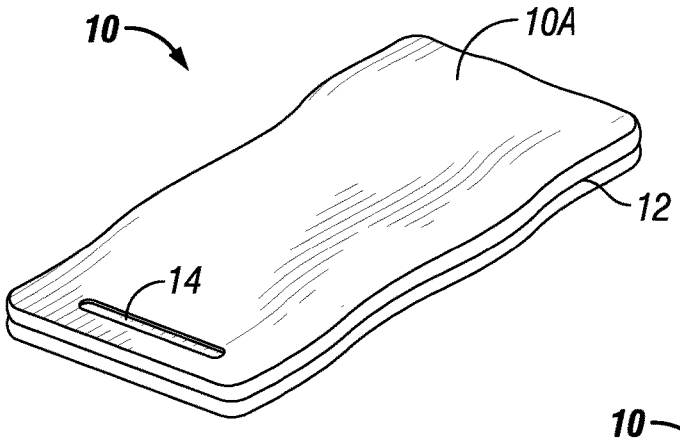
FIG. 7 is a perspective view of another simplified embodiment of a substance treatment member of this application including a rectangular type shape.
Figure 8:
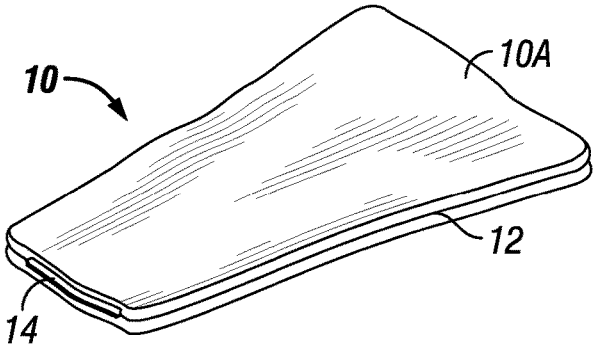
FIG. 8 is a perspective view of another simplified embodiment of a substance treatment member of this application including a trapezoid type shape.
Figure 9:
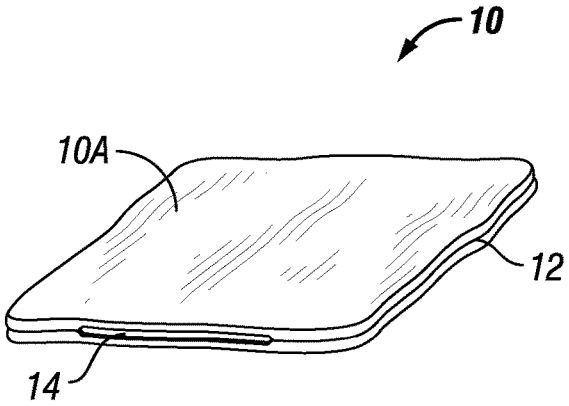
FIG. 9 is a perspective view of another simplified embodiment of a substance treatment member of this application including a rectangular type shape with four substantially similar sides.

Still referring to FIG. 5, one suitable "one size fits all" treatment member 10 may be defined by a circular or oval perimeter 12 with a mouth 14 or opening located along the perimeter 12 providing an insertion point for a shoulder cap 6 within the treatment member 10, i.e., the mouth 14 is operationally configured to receive a shoulder cap 6 there through. In another embodiment, a mouth 14 may be located at a location other than the perimeter 12—see mouth 14 in FIG. 7. In addition, other perimeter shapes such as rectangular and other multi-sided shapes may be employed for specific itemized operation or "one size fits all" operation—see FIGS. 7-9. Regardless of the perimeter shape employed, a "one size fits all" treatment member 10 suitably includes a shape and inner volume effective for use with shoulder caps 6 of various sizes and shapes.

Another suitable "one size fits all" type of treatment member 10 may be provided in a fixed shape and volume and be constructed from one or more flexible but non-stretchable materials for receiving a plurality of base members and/or shoulder caps 6 therein. As understood by the skilled artisan, a "one size fits all" type of treatment member 10 may form a more secure or close-fit form about one or more particular shoulder caps 6 than with other particular shoulder caps 6. In another embodiment, a "one size fits all" treatment member 10 may be constructed from one or more resilient materials or a combination of one or more resilient and one or more non-resilient materials effective for expanding or stretching from a first resting position or shape defined by an inner volume as shown in FIG. 5 to one or more different shapes and inner volumes for accommodating one or more particular size and shaped shoulder 5 caps 6 therein.

Figure 6:
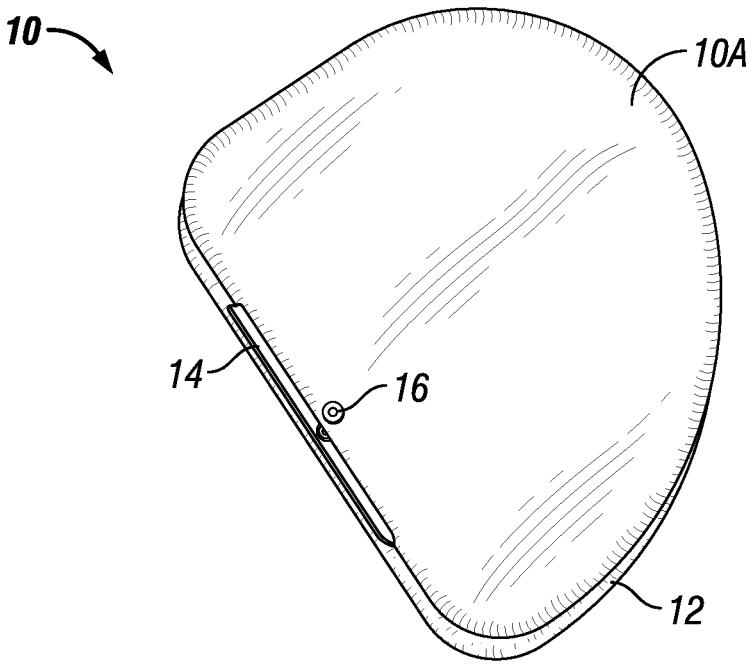
FIG. 6 is a perspective view of another simplified embodiment of a substance treatment member of this application.
Figure 10:
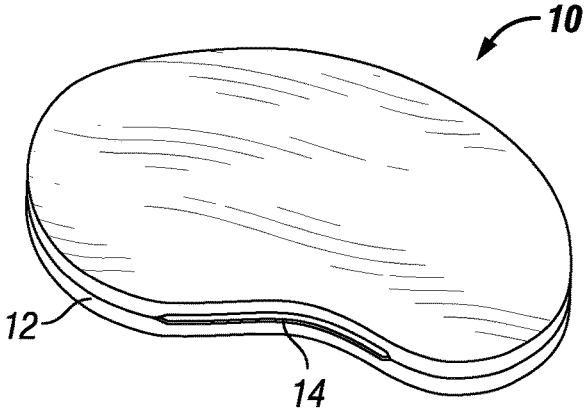
FIG. 10 is a perspective view of another simplified embodiment of a substance treatment member of this application including a kidney type shape as understood by the skilled 10 artisan.

In another embodiment, a treatment member 10 may be provided as a custom fit cover for use with a particular size and shape shoulder cap 6. In other words, the treatment member 10 has a substantially similar perimeter shape as its corresponding target base member or shoulder cap 6. As shown in FIG. 6, one exemplary slip-on treatment member 10 may be provided with an inner volume and perimeter 12 shape such as a non-circular or irregular shaped perimeter 12 that is operationally configured to mirror the perimeter shape of one or more known shoulder caps 6 to be set within the treatment member 10. As understood by persons of ordinary skill in the art of human anatomy, various commercially available shoulder caps 6 have what may be referred to as a "kidney shape," for example, see the shape of the shoulder caps 6 in FIG. 3. As such, a treatment member 10 may be provided in a corresponding kidney shape (see FIG. 10) for covering one or more corresponding kidney shaped shoulder caps 6. Regardless the type of removable slip-on treatment member 10 employed, a suitable removable slip-on treatment member 10 of this application is effective to envelop a shoulder cap 6 as shown in the simplified illustration of FIG. 11, which includes a treatment member 10 as shown in FIG. 6 covering a shoulder cap 6 as shown in FIG. 2. A treatment member 10 as shown in either of FIGS. 5 and 44 may also be employed to envelop a shoulder cap as shown in FIG. 2.

In one embodiment, a custom fit treatment member 10 may be constructed from one or more inelastic and/or non-resilient materials effective to form fit one or more particular shoulder caps 6. In another embodiment, a custom fit treatment member 10 may be constructed from one or more elastic and/or resilient materials. In still another embodiment, a custom fit treatment member 10 may be constructed from a combination of one or more elastic and/or resilient materials and one or more inelastic and/or non-resilient materials. In addition, the above described embodiments of the treatment member 10 may include individual parts sewn together, stitched together, glued together, adhered together via heat, chemically adhered together, and combinations thereof. For example, one suitable treatment member 10 may include a front surface 10A comprising a textile material of a particular textile composition one or more fiber types and a back surface 10B comprising a separate textile material of a particular textile composition, the two textile members being sewn together forming a perimeter 12 seam. In one embodiment, a back surface 10B may be constructed from one or more breathable fabrics. One suitable breathable fabric for this purpose is commercially available under the trade name Coolmax® from DuPont of Charlotte, N.C. In another embodiment, a treatment member 10 may include a front surface 10A comprising one or more textiles and a back surface 10B comprising foam padding to provide additional protection against impacts, e.g., where a catcher 99 has an injured shoulder requiring additional protective padding. In another embodiment, a treatment member 10 may include a front surface 10A and a back surface 10B comprising the same textile material(s) or substantially similar textile material(s).

As understood by the skilled artisan, the treatment member 10 may be built to scale and the thickness of the front surface 10A materials of construction and the thickness of the back surface 10B materials of construction may vary depending on the type(s) and amount of material used. Without limiting the invention to any one particular embodiment, where a front surface 10A of a treatment member 10 is constructed from textile material, for baseball usage the thickness of the textile material may range from about 0.5 mm to about 5.0 mm (from about 0.02 inches to about 0.196 inches). In addition, a treatment member 10 intended for baseball usage and constructed from one or more textile materials may include a weight greater than, equal to, or less than its corresponding base member or shoulder cap 6 although it may be beneficial to minimize any additional weight added to a base member or shoulder cap 6 by way of a removable treatment member 10. For example, it may be desirable in one embodiment to limit the weight of a treatment member 10 to about half or less than the weight of its corresponding base member or shoulder cap 6. One suitable treatment member 10 for baseball usage may include a weight ranging from about 5.67 grams to about 42.5 grams (about 0.2 ounces to about 1.5 ounces). However, heavier weights are herein contemplated where a treatment member 10 includes additional heavier materials of construction, e.g., metals, plastics, rubbers, ceramics, leathers. In one non-limiting embodiment including a base member or shoulder cap 6 having a weight of about 45.4 grams (about 1.6 ounces), a suitable treatment member 10 may have a weight of about 14.2 grams (about 0.5 ounces). As understood by the skilled artisan, when using a close-fitting "one size fits all" treatment member 10, the weight ratio between the treatment member 10 and base member or shoulder cap 6 may vary according to the weight of a given base member or shoulder cap 6 being used with a particular treatment member 10.

With reference to FIGS. 5-10, in one implementation a base member or shoulder cap 6 may be bent, folded or otherwise manipulated to be inserted and/or removed through a mouth 14 of a treatment member 10 defined by a specific maximum size and/or shape. In another implementation, a mouth 14 of a treatment member 10 may be constructed from one or more elastic and/or resilient materials effective to enlarge the opening of the mouth 14 for insertion and/or removal of a base member or shoulder cap 6 in and out of the treatment member 10. As a skilled artisan understands, a treatment member 10 having an enlargeable mouth 14 may include one or more elastic and/or resilient front and back surface 10A, 10B materials working in conjunction with one or more elastic and/or resilient materials of construction forming the perimeter of the mouth 14. One suitable mouth 14 may be constructed using elastic casing as such is understood in the art of sewing and the like. In another embodiment, a mouth 14 may include one or more elastic bands effective to enlarge the size of the mouth 14. For example, one suitable enlargeable mouth 14 may open to a maximum position ranging from about 100 percent (100.0%) to about 500 percent (500.0%) greater in perimeter length than the perimeter length of the mouth 14 in its original resting position. In another embodiment, a suitable resilient mouth 14 may open to a maximum size that is at least about 1.5 times greater in perimeter length than the size of the mouth 14 in its original resting position as seen in each of FIGS. 5-10.

Figure 12:
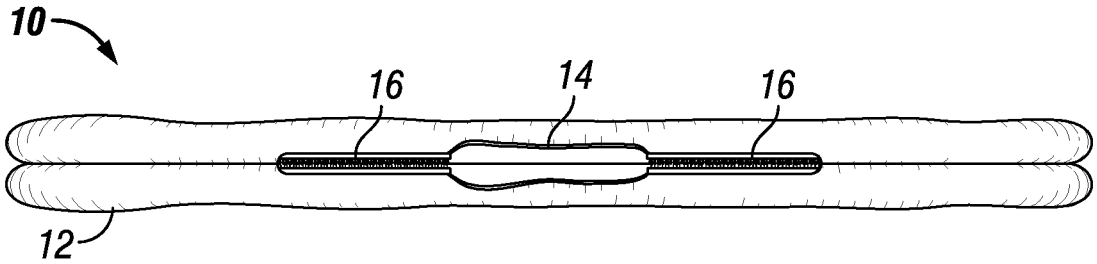
FIG. 12 is a side view of another simplified embodiment of a substance treatment member of this application.

It is also contemplated that a mouth 14 of a treatment member 10 may include one or more fasteners 16 operationally configured to adjust the size of the opening of the mouth 14 and/or set the mouth 14 between a closed position and an open position. For example, one or more fasteners 16 such as hook and loop fasteners may be disposed along the perimeter of the mouth 14 effective for completely sealing the mouth 14 or at least partially sealing the mouth 14 (see FIG. 12). As depicted in FIG. 12, hook and loop fasteners 16 may be provided as elongated continuous members. In another embodiment, hook and loop fasteners may be provided as smaller individual sectional members placed in abutment and/or spaced apart as desired.

In another embodiment, adhesive material may be employed in a manner similar as hook and loop fasteners as described above with reference to FIG. 12. Suitable adhesive materials include, but are not necessarily limited to adhesive tapes. Suitable adhesive tapes include, but are not necessarily limited to rubber foam and sponge tape including, for example, neoprene foam, ethylene propylene diene terpolymer ("EPDM") foam, styrene butadiene rubber ("SBR") foam, EPDM/SBR blended foam, ethylene propylene terpolymer (EPT), and combinations thereof.

With reference again to FIG. 6, in another embodiment one or more fasteners 16 may be provided as glue-on or sew-on snaps or the like for dictating the open/closed position of the mouth 14. In another embodiment, one or more fasteners 16 may be provided as fastenable buttons with corresponding button holes on the front and back surfaces 10A, 10B for dictating the open/shut position or the size of the mouth 14. In another embodiment, one or more magnet assemblies may be adhered to the front and back surfaces 10A, 10B for dictating an open/shut position or the size of the mouth 14. In still another embodiment, the treatment member 10 may include one or more pleats for adjusting the size of the mouth 14. In another embodiment, the treatment member 10 may include a zipper operationally configured to adjust the size of the opening of the mouth 14 ranging from a fully open position to a fully closed position similar as zippers used to open and close pockets on clothing. In another embodiment, pins, staples and/or crimps may be employed as fasteners 16. Also, a combination of two or more of the above described fasteners 16 may be employed as desired.

It is further contemplated that two or more treatment members 10 may cover a base member or shoulder cap 6 as desired. As a simplified example, a shoulder cap 6 may be inserted into a first treatment member 10, thereafter, the resulting shoulder cap assembly 8 may be inserted into a second treatment member 10, and so on until a shoulder cap 6 is housed within a desired number of additional treatment members 10. During operation, as a catcher 99 or other person, e.g., a manager, coach, teammate, parent, fan, umpire, decides that the time has come to stop using the outermost treatment member 10, such treatment member 10 may simply be removed thereby exposing the next outermost treatment member 10 for immediate use.

Figure 13:
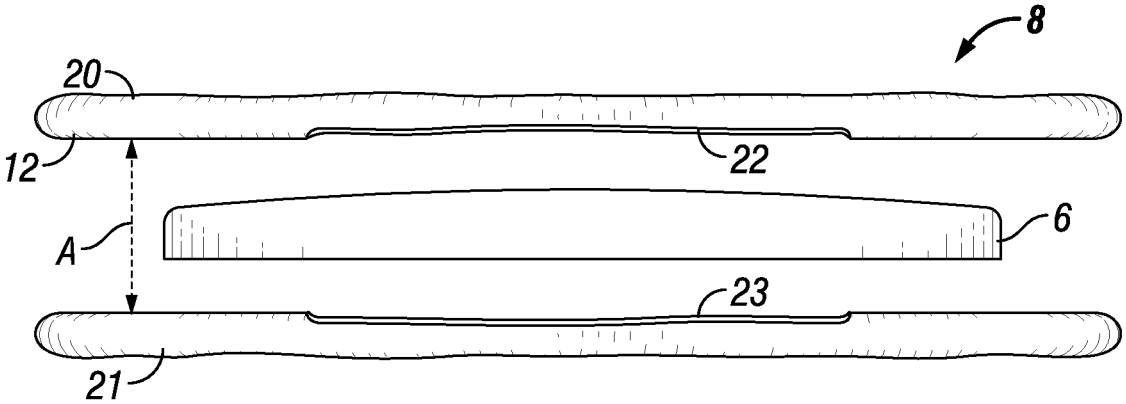
FIG. 13 is an exploded side view of a simplified embodiment of a shoulder cap assembly of this application.

Turning to FIG. 13, another suitable shoulder cap assembly 8 of this application may comprise a two-piece treatment member 10 operationally configured to sandwich and/or otherwise envelope a base member or shoulder cap 6. In this simplified illustration, the treatment member 10 suitably includes (1) a front member 20 operationally configured to cover the front surface of a base member or shoulder cap 6 and (2) a back member 21 operationally configured to cover the back surface of a base member or shoulder cap 6. The front member 20 and back member 21 are suitably attachable to one another near the perimeter 12 (see Arrow A) via one or more fasteners 16 similar as described above. In addition, the front and back members 20, 21 may include corresponding front and back mouth sections 22 and 23, e.g., cut-out sections, operationally configured to form a mouth 14 once the front and back members 20, 21 are assembled for treatment member 10 operation.

Figure 14:
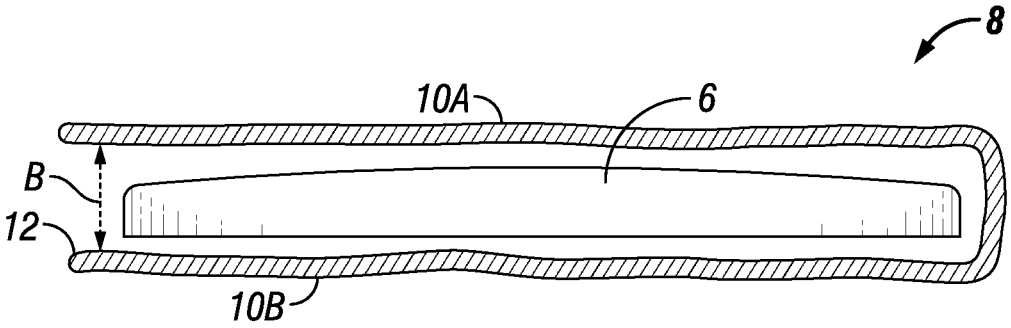
FIG. 14 is a side view of another simplified embodiment of a substance treatment member of this application.

Turning to FIG. 14, in another embodiment a treatment member 10 may be provided as a one-piece member operationally configured to fold or wrap around a base member or shoulder cap 6, the material defining the front surface 10A and back surface 10B being securable along or near the perimeter 12 (see Arrow B) of inner sides of each via one or more fasteners 16 similar as described above. In this embodiment, sections of each of the front and back surfaces 10A, 10B may be left unsecured for forming a mouth 14.

Figure 15:
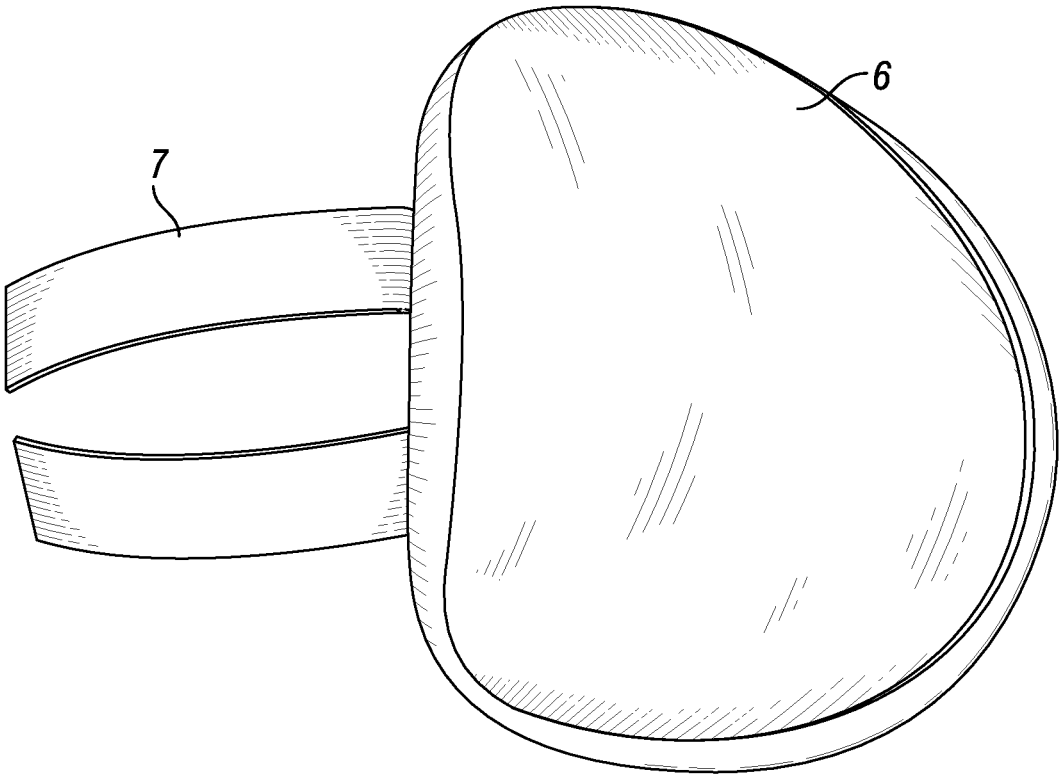
FIG. 15 is a simplified front view of a commercially available shoulder cap with attachment members.

Turning to FIG. 15, it is understood by the skilled artisan that baseball shoulder caps 6 often include one or more attachment members 7 for releasably attaching the shoulder cap 6 to a chest protector 5. Likewise, a shoulder cap assembly 8 of this application may include one or more attachment members 7 operationally configured to releasably attach the shoulder cap assembly 8 to a chest protector 5. Suitable attachment members 7 typically include one or more elongated members provided with hook and loop fasteners, snaps, hooks, buttons that correspond to fasteners located on a corresponding chest protector 5. As such, a suitable mouth 14 of a treatment member 10 is operationally configured to provide an opening for the one or more attachment members 7, or other type of attachment configuration, to extend from a point within the treatment member 10 out through the mouth 14 to one or more attachment points on a chest protector 5. In the embodiment of FIG. 15, which depicts a shoulder cap 6 having two attachment members 7, one or more fasteners 16 may be disposed along a treatment member 10 in a manner effective for securing the front surface 10A and a back surface 10B at one or more locations between the two attachment members 7 forming dual mouths 14 for each of the attachment members 7—see, for example, the fastener 16 in FIG. 6, which is located along the treatment member 10 in a manner effective to fasten unobstructed between two attachment members 7 as shown in FIG. 15. In other embodiment, removable shoulder caps 6 and other wing like members may be attached directly to a chest protector 5 bypassing the need for attachment members 7—see, for example, U.S. Pat. No. 6,678,899, published Jan. 20, 2004, titled "Chest Protector," which is incorporated by reference in its entirety.

Figure 16:
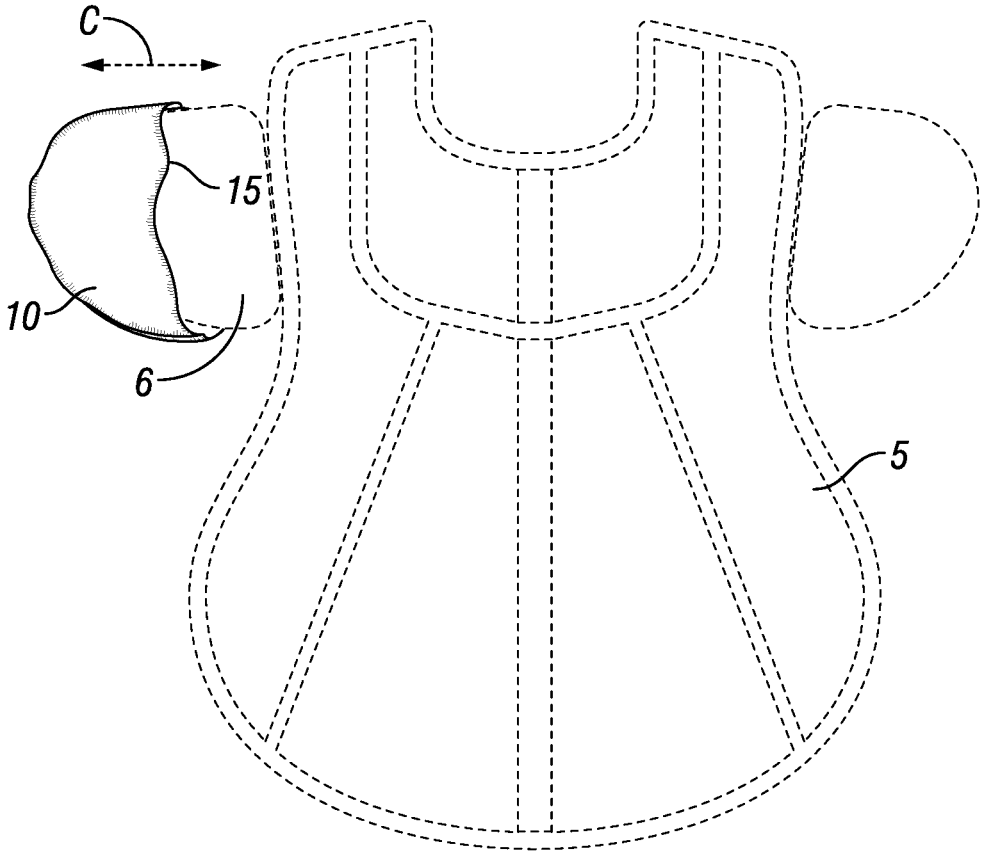
FIG. 16 is a front view of a chest protector including a demonstrative mating of a substance treatment member to a shoulder cap of the chest protector.

In still another embodiment, a treatment member 10 may be provided as a sleeve type cover member with an opening 15 substantially similar in diameter as the size of the treatment member 10 for slipping on and off a shoulder cap 6 (see Arrow C in FIG. 16). In such an embodiment, a draw string or the like, or one or more of the above described fasteners 16, may be included along the opening 15 of the treatment member 10 for adjusting the size of the opening 15. The size of an opening 15 in the embodiment of FIG. 16 may also be adjusted in size via tape, string, one or more tie-wraps, and combinations thereof, for securing a shoulder cap 6 within the treatment member 10.

Figure 17:
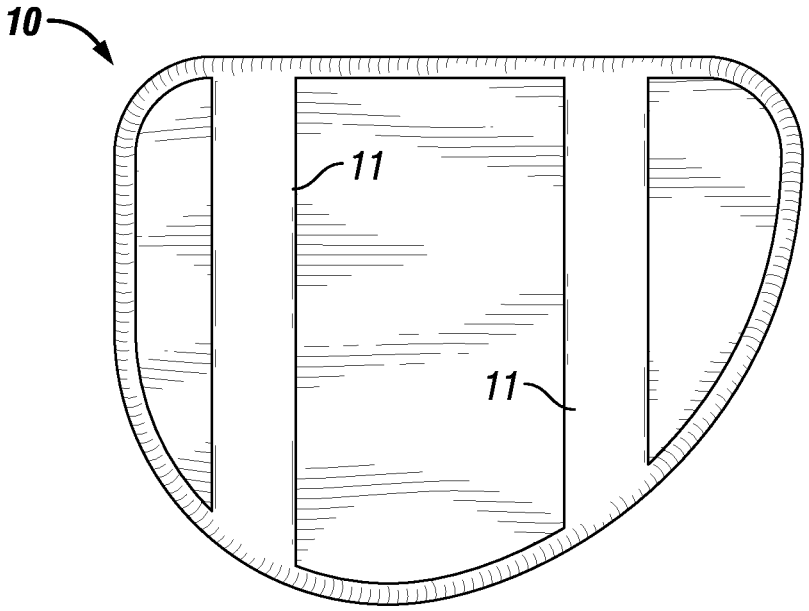
FIG. 17 is a back view of a simplified embodiment of a substance treatment member of this application.

In still another embodiment, treatment members 10 similar as depicted in FIGS. 5-10 may include a minimal amount of surface construction material(s) of construction as desired. As shown in the simplified illustration of FIG. 17, one suitable treatment member 10 may comprise a non-continuous back surface 10B defined by one or more back side members 11 effective to minimize the amount of materials of construction of a back surface 10B. One suitable back surface 10B may include one or more resilient back side members 11 such as elastic fabric and the like and/or one or more non-resilient materials, e.g., in band or strip form, as desired or as may otherwise be required for operation.

Figure 18:
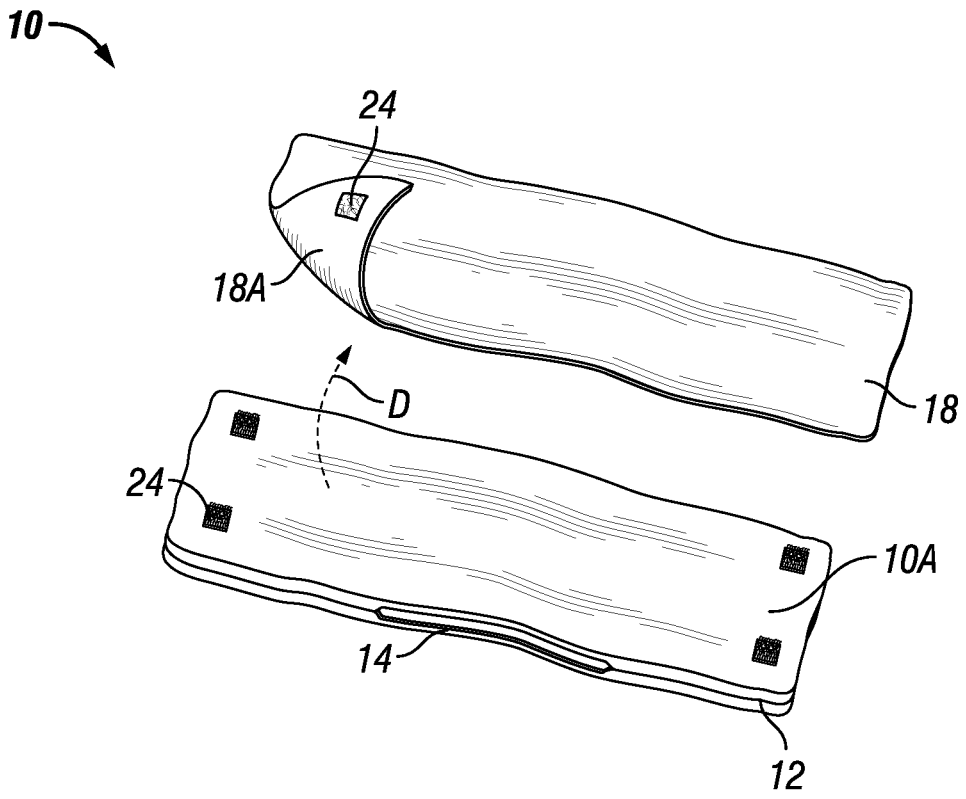
FIG. 18 is a perspective view of another simplified embodiment of a substance treatment member of this application including a removable layer in a removed position.

In yet another embodiment, a treatment member 10 may be provided as a slip-on cover as described above including a front surface 10A having one or more removable layers 18 (or "sheets") of substance treating material(s)—see Arrow D in FIG. 18. In one implementation, a first removable layer 18 comprised of one or more substance treatment material(s) may be (1) releasably attached to the front surface 10A via fasteners 24 and/or (2) wrap around and attach to the back surface 10B via fasteners 24, e.g., snaps, hook and loop fasteners, adhesive materials, tape, pins, staples, crimps, and combinations thereof. Once a first removable layer 18 is applied to the front side 10A, one or more additional removable layers 18 may be releasably attached to the first removable layer 18 in a stacked formation so that as an outermost removable layer 18 is removed the next adjacent inner layer is exposed for immediate use. In such embodiment, an outermost removable layer 18 may be removed and/or disposed of once such layer is no longer in condition for use as a result of saturation, dirtiness, fungi, e.g., mold and/or mildew, bacteria, disfigurement, odors, material damage, e.g., holes, tears, and combinations thereof. Such removable layer 18 may be washed or cleaned for reuse or disposed of. In the simplified example of FIG. 18, the treatment member 10 is depicted as having corresponding hook and loop fasteners 24 located at or near the perimeter of the front surface 10A and an inner surface 18A of the removable layer 18.

Figure 19:
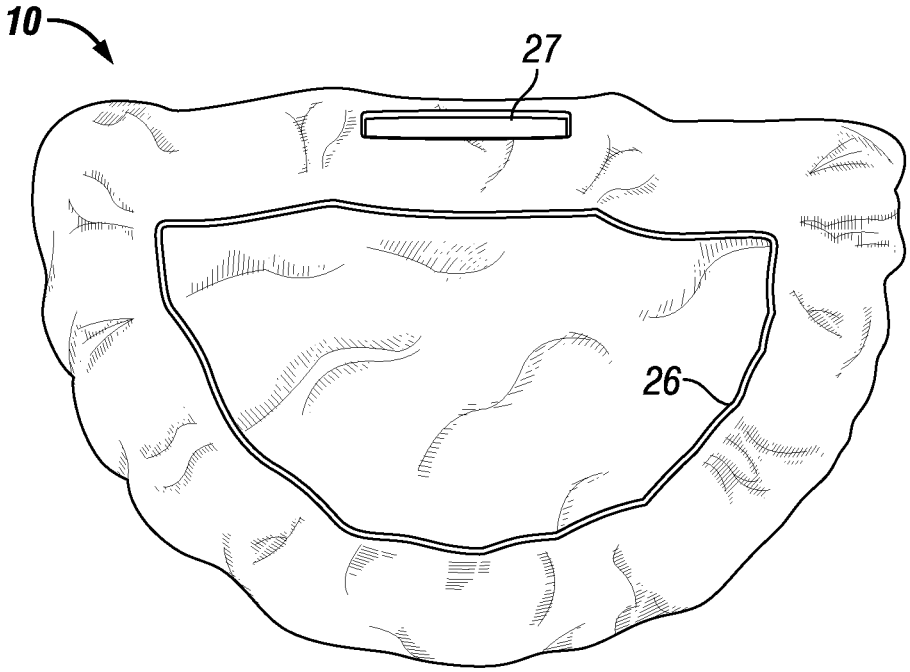
FIG. 19 is a back view of another simplified embodiment of a substance treatment member of this application.
Figure 20:
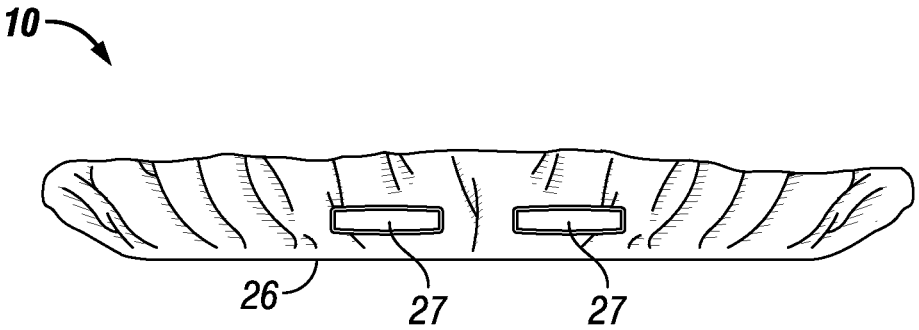
FIG. 20 is a side view of another simplified embodiment of a substance treatment member of this application.
Figure 21:
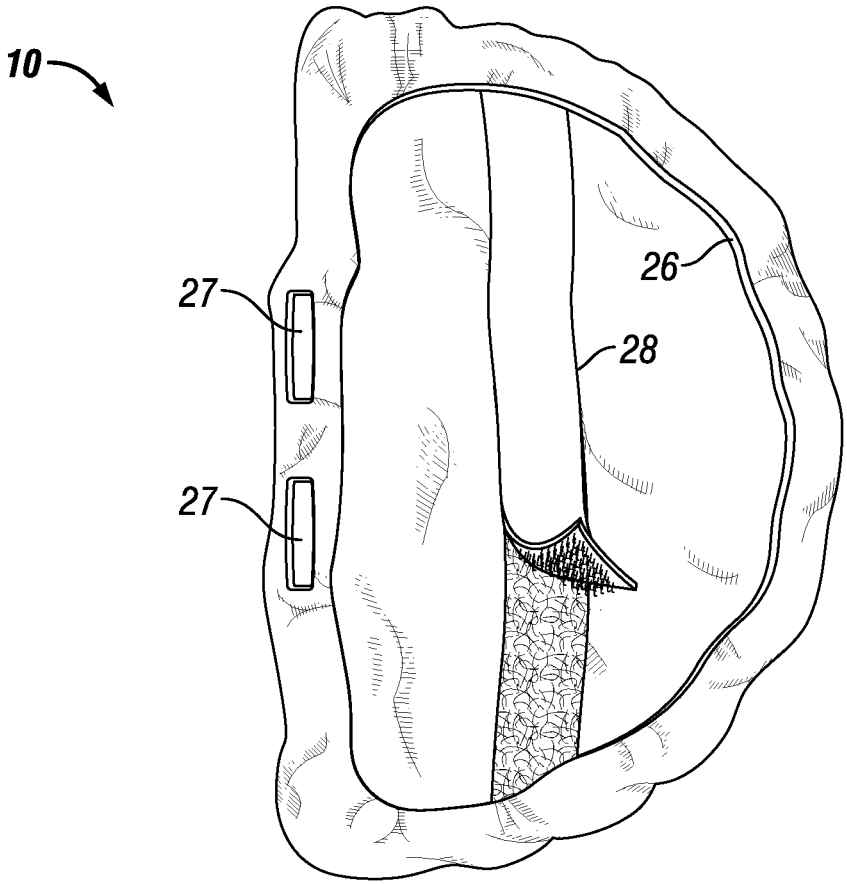
FIG. 21 is a back view of another simplified embodiment of a substance treatment member of this application.
Figure 22:
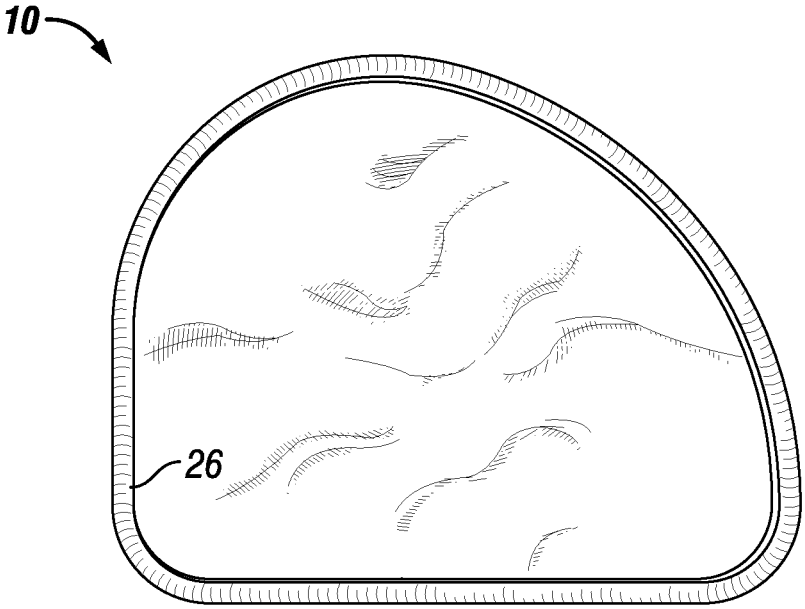
FIG. 22 is a front view of another simplified embodiment of a substance treatment member of this application.

In another embodiment, a treatment member 10 may be provided as a removable cap type member operationally configured to cover a front surface of a base member or shoulder cap 6. As shown in the simplified illustration of FIG. 19, a cap type treatment member 10 may include an elastic or resilient perimeter 26 operationally configured to wrap around to the back surface of a base member or shoulder cap 6 in a manner effective to secure the treatment member 10 to the base member or shoulder cap 6. In one embodiment, the treatment member 10 may form fit a front surface of a base member or shoulder cap 6. For purposes of simple explanation and not to limit the scope of the invention, this embodiment of a removable cap type treatment member 10 may fit onto a base member or shoulder cap 6 in a manner similar as to how a buffing pad or polishing pad fits onto a buffer or polisher. As shown in FIGS. 19 and 20, the treatment member 10 may also include one or more apertures 27 for receiving one or more attachment members 7 there through. As such, the treatment member 10 of this embodiment is not encumbered by the one or more attachment members 7 extending out from the shoulder cap 6. FIG. 21 provides another simplified embodiment of a removable cap type treatment member 10 including one or more fasteners 28 disposed along the back surface of the base member or shoulder cap 6 during operation. One suitable fastener 28 may include a two-part system including opposing members as shown in FIG. 21. In another embodiment, a single fastener 28 may be disposed across the perimeter 26. In still another embodiment, securement of a treatment member 10 to a base member or shoulder cap 6 may be accomplished solely via one or more fasteners 28 in an embodiment where the treatment member 10 does not include a resilient perimeter 26. In one suitable embodiment, one or more fasteners 28 may include overlapping hook and loop fastening members as shown in FIG. 21. As stated above, a removable cap type treatment member 10 may be operationally configured to provide a form fit along the front surface of a base member or shoulder cap 6. As such, a treatment member 10 of this embodiment may include a shape corresponding to the shape or surface configuration of the front surface of one or more particular base members or shoulder caps 6—see the treatment member 10 of FIG. 22, which is operationally configured to releasably attach to a shoulder cap 6 as shown in FIG. 2. In one embodiment, a resilient perimeter 26 may be constructed from one or more elastic materials. In another embodiment, a perimeter 26 may be constructed from one or more malleable materials such as metal wire and the like effective to be form fit along the surface of the shoulder cap 6 as desired. One suitable perimeter 26 may be constructed using elastic casing as such is understood in the art of sewing and the like. In another embodiment, a perimeter 26 may include one or more elastic bands effective to enlarge the size of the perimeter 26.

The shoulder cap assembly 8 including the treatment member 10 may be constructed from one or more materials as desired. For example, the shoulder cap assembly 8 and/or the treatment member 10 may be constructed from materials including, but not necessarily limited to those materials resistant to chipping, cracking, deformation, brittling, fraying, wearing, undesired stretching, and a combination thereof, as a result of ultra-violet light, ozone, weathering, heat, moisture, other outside mechanical and/or chemical influences, as well as various impacts and other loads placed onto the one or more materials of construction of the shoulder cap assembly 8 including the treatment member 10. Likewise, a shoulder cap assembly 8 including a treatment member 10 of this application may comprise any color or combination of colors as desired or as may otherwise be required pursuant to any applicable laws, rules or regulations, e.g., baseball rules or regulations. In addition, a shoulder cap assembly 8 including a treatment member 10 may also be constructed from one or more materials designed or treated to 5 provide ultra-violet light protection and/or antimicrobial properties and/or anti-fungal properties and/or flameproofing, oilproofing, waterproofing or water resistance properties as understood in the art of textiles—see, for example, U.S. Pat. No. 3,441,433, published Apr. 29, 1969, titled "Process for flameproofing, waterproofing and oilproofing textile materials;" U.S. Pat. No. 4,062,818, published Dec. 13, 1977, titled "Composition for imparting flame resistance and water repellency to textiles;" U.S. Pat. No. 5,380,260, published Jan. 10, 1995, titled "Medical paddings;" U.S. Pat. No. 7,501,471, published Mar. 10, 2009, titled "Waterborne hydrophobic barrier coatings," U.S. Pat. No. 4,987,632, published Jan. 29, 1991, titled "Wiping article;" each of which is herein incorporated by reference in its entirety.

Figure 44:
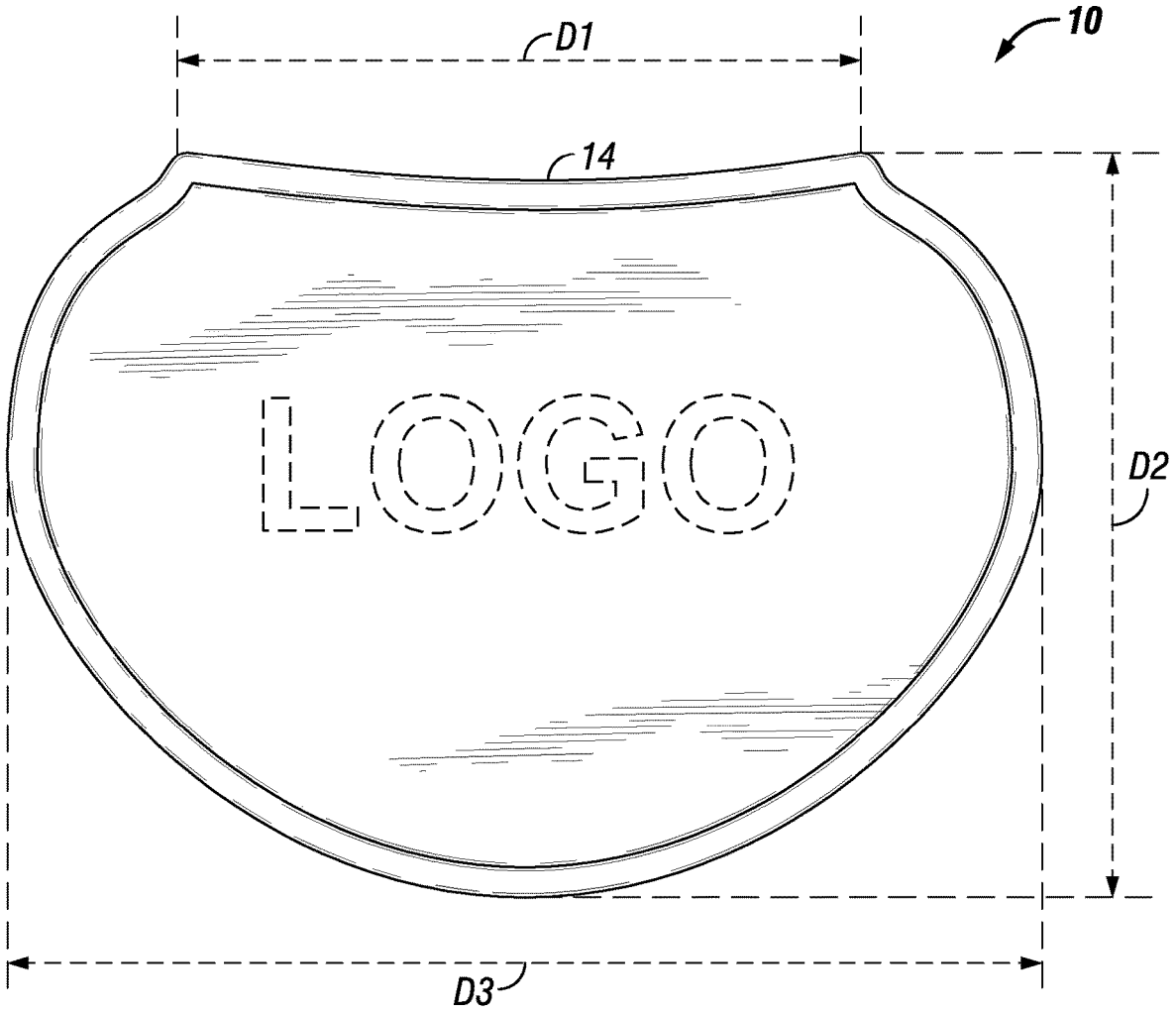
FIG. 44 is a front view of another simplified embodiment of a substance treatment member of this application.

In addition, because a shoulder cap assembly 8 may be used in team sports, one or more team logos, team nicknames, sponsor names, cities, counties and/or states, field/stadium name, player's names and/or initials, and combinations thereof may be placed on a treatment member 10, or other part of a shoulder cap assembly 8, in a permanent or removable manner and in an orientation as desired (see the non-limiting exemplary "LOGO" in FIG. 44). In military and/or law enforcement applications, a treatment member 10 may include an outer surface color(s) or color scheme for one or more particular purposes including, but not necessarily limited to a camouflage pattern as desired or otherwise required per military standard or "MIL-SPEC."

Without limiting the invention in scope, suitable treatment member 10 materials of construction may include, but are not necessarily limited to textiles, metals, plastics, rubbers, ceramics, leathers, synthetic textiles, high-performance textiles, furs, sponge, and combinations thereof. Suitable textiles may be constructed from natural fibers, synthetic fibers, and combinations thereof. In addition, suitable textiles may include, but are not necessarily limited to woven fabrics, non-woven fabrics, knitted fabrics, netting fabrics, technical fabrics, and combinations thereof selected according to properties such as softness, toughness, absorption, water repellency, electrostatics, and filtering capabilities. In one implementation, suitable fabrics may include moisture absorbing fibers such as cotton, hemp, bamboo, jute, composite fabrics, and combinations thereof. One suitable composite fabric may be constructed from tangled cellulose fibers and poly microfibers. Suitable textiles may also include perforations, dimples, and combinations thereof. As understood by the skilled artisan, textile fibers may be provided in various shapes including, but not necessarily limited to flat oval, oval to round, triangular with rounded edges, circular, dog-bone, lobular, Y-shaped, ribbon-shaped, circular serrated, and trilobal. One exemplary flat oval fiber includes cotton fiber. One exemplary oval to round fiber includes wool fiber. One exemplary triangular fiber with rounded edges includes nylon fiber. Exemplary circular fibers include nylon and cuprammonium rayon fibers. One exemplary dog-bone shaped fiber includes orlon fibers. One exemplary lobular shaped fiber includes acetate fibers. One exemplary Y-shaped fiber includes nylon fiber. One exemplary ribbon-shaped fiber includes synthetic acrylic resin fibers. One exemplary circular serrated fiber includes viscose rayon. One exemplary trilobal fiber includes nylon fibers under the brand name ANTRON®.

Suitable woven fabric materials include, but are not necessarily limited to cotton voile, cotton lawn, rayon challis, chambray, fleece, denim, double gauze, knit fabric, silk, satin, linen, wool, flannel, canvas, synthetic fabrics, and combinations thereof. The woven fabric materials of this application are not limited to any particular thread count as such term is understood by persons of ordinary skill in the field of textiles. Suitable synthetic fabrics include, but are not necessarily limited to thermoplastic polymers such as polyester and/or polypropylene, acrylic, nylon, rayon, acetate, spandex, lastex, orlon, and combinations thereof. Suitable non-woven fabrics include, but are not necessarily limited to sheet or web structures bonded together by entangling fiber or filaments (and by perforating films) mechanically, thermally or chemically, for example, geotextiles, felt, diaperstock having hydrophilic and/or hydrophobic layers, and combinations thereof. In addition, backing material may be employed with one or more textiles. Suitable backing material include, but are not necessarily limited to polyurethane foam, latex foam, paper products such as cardboard, and combinations thereof.

Suitable metals include, but are not necessarily limited to steel, aluminum, iron, titanium, molybdenum, nickel, copper, combinations thereof and alloys thereof. Suitable plastics include, but are not necessarily limited to vinyl polymers, polyvinyl chloride (PVC), any combinations thereof. The plastic material(s) employed may be optically transparent or non-transparent, clear or colored. Suitable rubbers include, but are not necessarily limited to natural rubbers, synthetic rubbers and combinations thereof. Suitable ceramics include, but are not necessarily limited to inorganic materials such as pottery, enamels and refractories and include but are not limited to metal silicates, metal oxides, metal nitrides and combinations thereof. Suitable synthetic textiles include, but are not necessarily limited to alternative leathers or faux leathers as the terms are understood by the skilled artisan. Suitable high-performance textiles include, but are not necessarily limited to aramid fibers. One exemplary aramid fiber material includes para-aramid synthetic fibers, which is commercially available from E. I. du Pont de Nemours and Company, Wilmington, Del., under the brand name KEVLAR®.

The shoulder cap assembly 8 including the treatment member 10 materials of construction may be colored in one or more ways common in textile coloring practices. For example, treatment member 10 materials of construction may be colored via dyeing using dyes, natural dyes, synthetic dyes, basic dyes, direct dyes, mordant dyes, vat dyes, reactive dyes, disperse dyes, sulfur dyes, pigment dyes, and combinations thereof. Dyeing may be accomplished using methods known to persons of ordinary skill in the art of textile dyeing. Exemplary methods include, but are not necessarily limited to stock dyeing, piece dyeing, solution pigmenting and dye sublimation printing. In an embodiment using dye sublimation printing, the treatment member 10 materials of construction include "sublimation fabrics" as the term is understood by persons of ordinary skill in the art of dye sublimation printing. Suitable sublimation fabrics may include, but are not necessarily limited to nylon, polyester, vinyl, canvas, and combinations thereof. One particular sublimation fabric suitable for use includes polyester/spandex fabric blend.

In one particular embodiment, a treatment member 10 may include at least a front surface 10A constructed from one or more moisture absorbing textile materials and/or layers of materials operationally configured to hold from about 1.5 times up to about 350.0 times its weight in water. In one embodiment, a treatment member 10 may include a single layer of one or more textile materials defining an outermost material surface and an innermost material surface of a front surface 10A of a treatment member 10. In another particular embodiment, a treatment member 10 may include a plurality of layers of one or more textile materials defining an outermost material surface, an inner most material surface and at least a first inner surface material in an embodiment comprising three or more layers of one or more textile materials.

In another particular embodiment, a treatment member 10 may include at least a front surface 10A with an outermost material surface constructed from a textile material 5 comprised of a 50/50 blend of cotton/polyester. In another particular embodiment, a treatment member 10 may include at least a front surface 10A with an outermost material surface constructed from a textile material comprised of a 100.0 percent cotton fabric. In another particular embodiment, a treatment member 10 may include at least a front surface 10A with an outermost material surface constructed from one or more textiles comprising one or more moisture absorbing microfibers and/or split microfibers. A suitable microfiber textile may include a grams per square meter ("GSM") ranging from about 100 GSM up to about 700 GSM. In another particular embodiment, a treatment member 10 may include at least a front surface 10A with an outermost material surface constructed from a combination of polyester and polyamide microfibers. In another particular embodiment, a treatment member 10 may include at least a front surface 10A with an outermost material surface constructed from polyester. In another particular embodiment, a treatment member 10 may include at least a front surface 10A with an outermost material surface constructed from a polyester and spandex blend. In another particular embodiment, a treatment member 10 may include at least a front surface 10A with an outermost material surface constructed from a microfiber towel of about 300 GSM. In another particular embodiment, a treatment member 10 may include at least a front surface 10A with an outermost material surface constructed from a microfiber towel of about 220 GSM. In another particular embodiment, a treatment member 10 may include at least a front surface 10A with an outermost material surface constructed from a microfiber towel of about 360 GSM. In another particular embodiment, a treatment member 10 may include at least a front surface 10A with an outermost material surface constructed from a microfiber towel of about 400 GSM. In another particular embodiment, a treatment member 10 may include at least a front surface 10A with an outermost material surface constructed from a microfiber towel of about 600 GSM. In another particular embodiment, a treatment member 10 may include at least a front surface 10A with an outermost material surface constructed from a waffle weave pattern microfiber towel of about 350 GSM. In another particular embodiment, a treatment member 10 may include at least a front surface 10A with an outermost material surface constructed from natural wool. In another particular embodiment, a treatment member 10 may include at least a front surface 10A with an outermost material surface constructed from moisture absorbing cotton fabrics made from carded yarn with a weight ranging from about 150 GSM to about 380 GSM. In another particular embodiment, a treatment member 10 may include at least a front surface 10A with an outermost material surface constructed from looped pile fabric, e.g., cotton with nylon and/or polyester, as found in known athletic sweat bands and the like. In still another particular embodiment, an outermost material surface of a front surface 10A may be constructed from moisture absorbing cotton terrycloth towel type material. It is also contemplated that a front surface 10A include a plurality of textile layers, with one or more inner layers having one or more properties as described above in this paragraph. The back surface 10B may also include one or more substance treatment materials as described above in this paragraph. In yet another embodiment, a treatment member 10 may include at least a front surface 10A constructed from one or more biodegradable fabrics including, but not necessarily limited to nonwoven cotton fabric, nonwoven bamboo fabric, and polyethylene terephthalate nonwoven fabric, and combinations thereof.

In another implementation, a shoulder cap assembly 8 of this application may include one or more treatment members 10 provided as a built in feature of a base member or shoulder cap 6 as opposed to a removable treatment member 10 as described above. In such embodiment, one or more treatment members 10 are suitably provided as an integral part of the outer casing or outer surface of a base member or shoulder cap 6. Such assembly may be accomplished during manufacturing of the shoulder cap assembly 8 or as a modification to a pre-existing base member or shoulder cap 6.

As understood by persons of ordinary skill in the art of the game of baseball, over the past century the front surfaces 5A of known chest protectors 5 have been constructed from durable materials such as heavy cotton fabric blends, leather, canvas, synthetic leather, to today's synthetic textile materials, e.g., fabrics comprising synthetic fibers and/or synthetic blends, and cotton/synthetic blends, including, but not necessarily limited to (1) waterproof textiles such as polyurethane fabrics like polyester and polyblends of fibers and (2) polyamide fiber materials such as nylon and nylon blends. Such durable materials are employed to provide functional strength to a chest protector 5 and guard against undesired wearing, deformation or destruction of a front surface 5A of a chest protector 5 over time.

One commercially available chest protector 5 available as of the time of this application includes a front surface 5A constructed of nylon satin. Another commercially available chest protector 5 available as of the time of this application includes a front surface 5A constructed of polyester satin. Another commercially available chest protector 5 available as of the time of this application includes a front surface 5A constructed of one or more ballistic fabrics. Another commercially available chest protector 5 available as of the time of this application includes a front surface 5A constructed of ballistic nylon-polyester fabrics. Another commercially available chest protector 5 available as of the time of this application includes a front surface 5A constructed of nylon spandex fabrics. Another commercially available chest protector 5 available as of the time of this application includes a front surface 5A constructed of ballistic nylon fabric. As further understood by the skilled artisan, commercially available shoulder caps 6 include one or more inner shock-absorbing materials such as shock-absorbent foam member enveloped within an outer casing 29 defining a front surface and back surface of the shoulder cap 6. Suitable shock-absorbing foams may include, but are not necessarily limited to ethylene-vinyl acetate ("EVA"), polyethylene, polyurethane, vinyl nitrile, and combinations thereof. As understood by the skilled artisan, shock-absorbing foams may be die cut from sheet stock or compression molded into three dimensional forms. Shoulder caps 6 may also including one or more plastic members disposed between and/or along one or more outer surfaces of one or more foam members.

Figure 23:
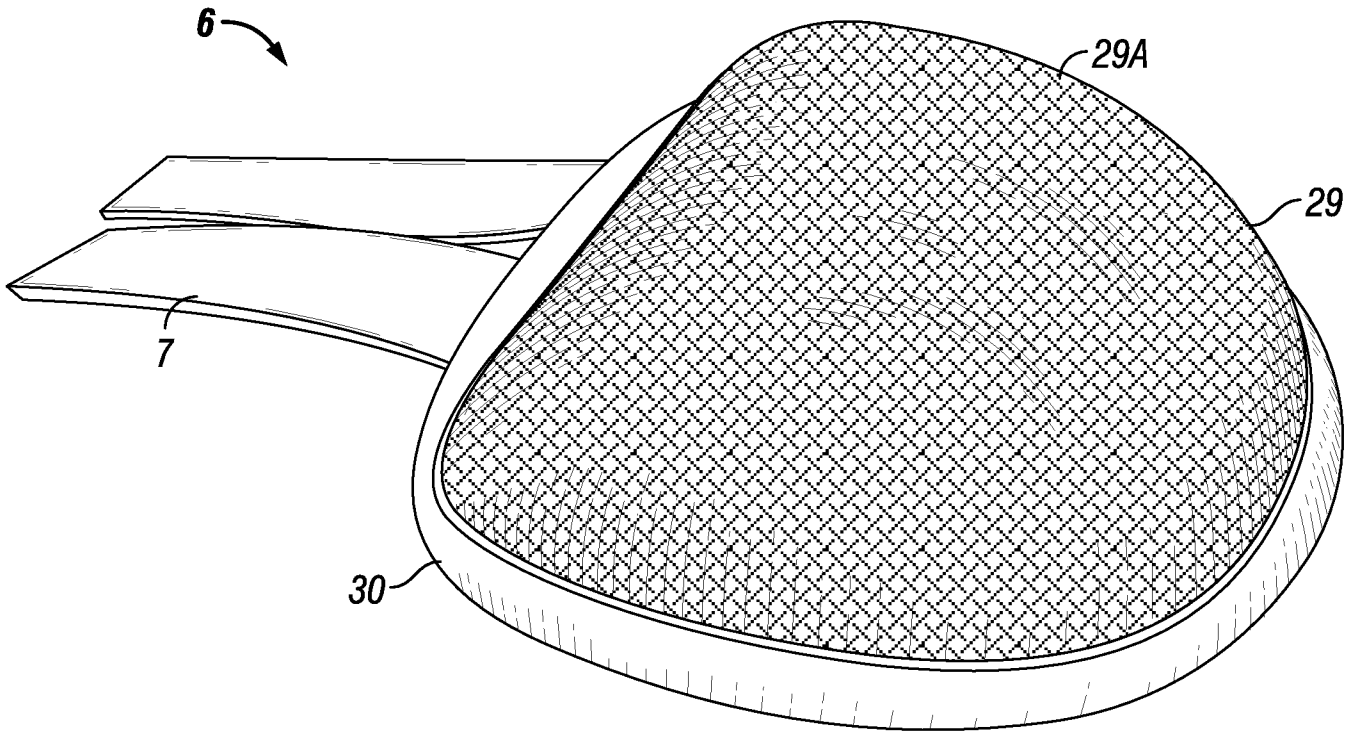
FIG. 23 is a simplified front perspective view of a commercially available shoulder cap.

Turning to FIG. 23, in one mode of construction an outer casing 29 of a known shoulder cap 6 may include a front surface layer 29A of material and a back surface layer 29B of material with a perimeter edge binding 30 of material that is stitched to the front and back surface layers 29A, 29B for securing each layer. Because the shoulder cap 6 has become a familiar or custom part of commercially available chest protectors 5, chest protectors 5 and their corresponding shoulder caps 6 are constructed from the same or substantially similar outer surface materials. Such construction provides both material and visual uniformity to the chest protector 5 product as a whole and provides shoulder caps 6 with the same durability as the chest protector 5. In other words, in the field of commercially available baseball chest protectors 5 the front surface layer 29A of the outer casing of a shoulder cap 6 includes the same material(s) of construction as the front surface 5A of its corresponding chest protector 5. Accordingly, the present application provides one or more treatment members 10 operationally configured to cover a front surface layer 29A of a shoulder cap 6 in a manner effective for the front surface 10A of the one or more treatment members 10 to operate as the front surface layer 29A of the shoulder cap assembly 8 providing a front surface layer 29A distinguishable in construction and target substance treating effectiveness compared to the front surface 5A of its corresponding chest protector 5.

Figure 11:
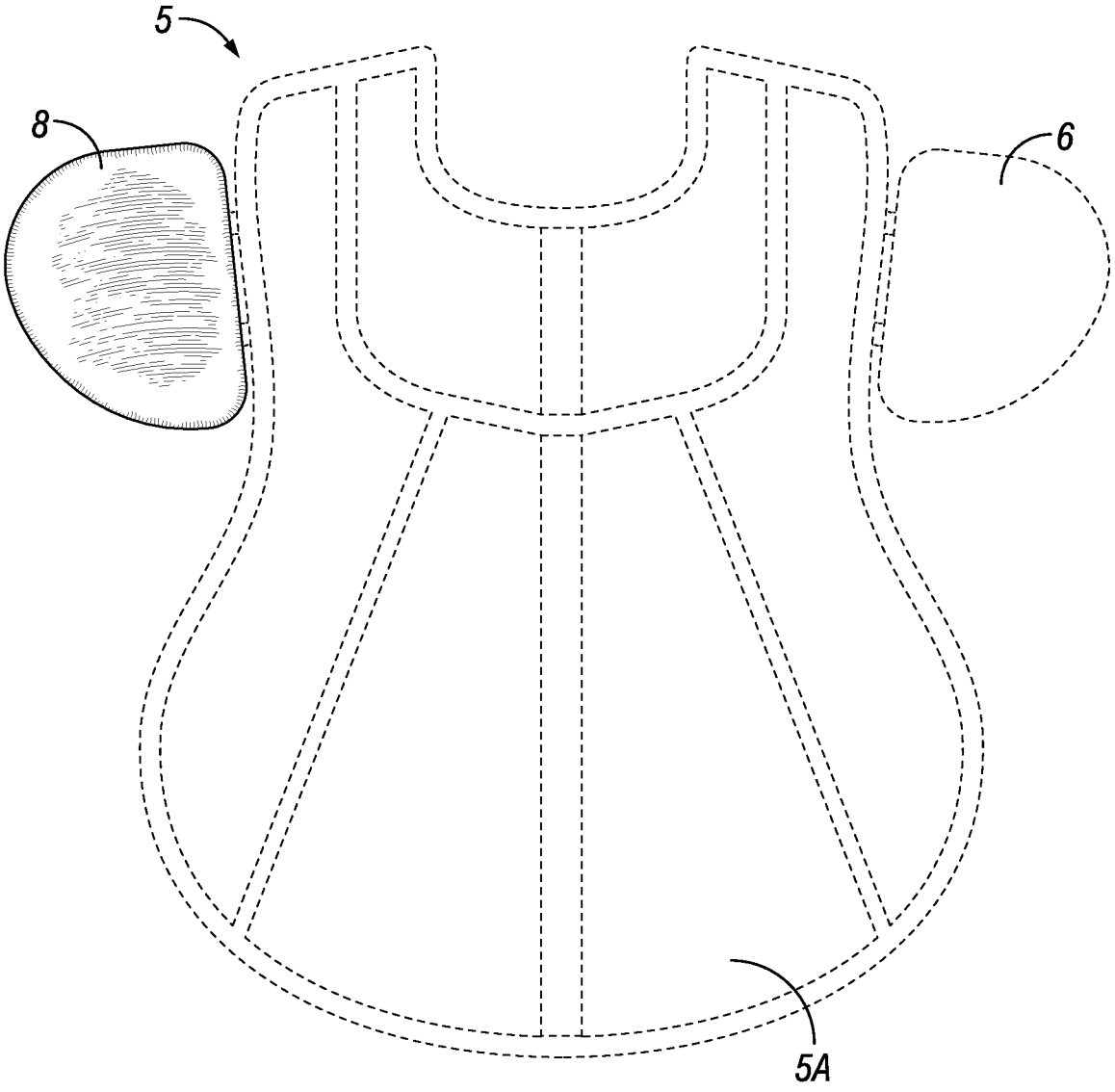
FIG. 11 is a front view of a chest protector including a shoulder cap assembly of the present application.

In addition, in an embodiment of a slip-on cover type treatment member 10 operationally configured to cover a shoulder cap 6 as depicted in FIG. 11, the treatment member 10 may be operationally configured to align the perimeter 12 of the treatment member 10 along the edge binding 30 of the shoulder cap 6. As such, the front surface 10A and a back surface 10B of the treatment member 10 may include different surface areas effective for alignment of the perimeter 12 along the edge binding 30 according to the size and/or shape of a target shoulder cap 6. In another embodiment, the front surface 10A may include one or more materials of construction having a fabric elasticity different than the one or more materials of construction of the back surface 10B that is operationally configured to align the perimeter 12 along the edge binding 30 according to the size and/or shape of a target shoulder cap 6.

Notwithstanding the pleasurable ornamental features of today's commercially available baseball chest protectors 5 and shoulder caps 6, the durable outer surface materials currently used may be considered as (1) abrasive or uncomfortable when applied to a person's skin and/or (2) include (a) hydrophobic synthetic fabrics, e.g., impermeable synthetic fibers preventing water penetration, and/or (b) semi-hydrophilic fabrics, e.g. synthetic fibers extruded into one or more shapes having cross-sections effective to capture some fluid. In addition, some synthetic fabrics used in chest protector/shoulder cap construction, such as polypropylene, are oleophilic meaning that in a scenario where oil is absorbed into the front surface of the outer casing 29, e.g., sun screen from a catcher's 99 face, the potential for water absorption decreases. As such, it is herein contemplated that a shoulder cap assembly 8 may be provided with one or more treatment members 10 defining at least part of the front surface layer 29A of a shoulder cap 6, the one or more treatment members 10 comprising materials of construction different than the materials of construction defining the front surface of the corresponding chest protector 5. In other words, the one or more materials of construction of the one or more treatment members 10 may be (1) softer to a person's touch and/or (2) have increased hydrophilicity, i.e., a greater moisture regain by weight, and/or (3) increased moisture wicking properties as compared to the corresponding chest protector 5 front surface 5A materials of construction.

As is understood by the skilled artisan, the phrase "moisture regain" in regard to textile materials refers to the equilibrium weight of water contained by a specimen expressed as a percentage of its oven-dry weight. In other words, it is the amount of water a completely dry fiber will absorb from the air at a standard condition of 21.1 degrees Celsius (70.0 degrees Fahrenheit) and a relative humidity of 65%. The moisture regain percentages of several textile materials are described in TABLE 1 below.

TABLE 1

| Textile Material | Moisture Regain (%) |
|---|---|
| Polypropylene | <0.1 |
| Polyester | 0.4-0.5 |
| Nylon | 4.0-4.5 |
| Cotton | 8.5 |
| Wool | 13.6-18.0 |
| Linen: | |
| Flax | 12.0 |
| Jute | 14.0 |
| Hemp | 12.0 |
| Silk | 11.0 |
| Rayon | 11.0 |
| Spandex | 1.3 |

Figure 24:
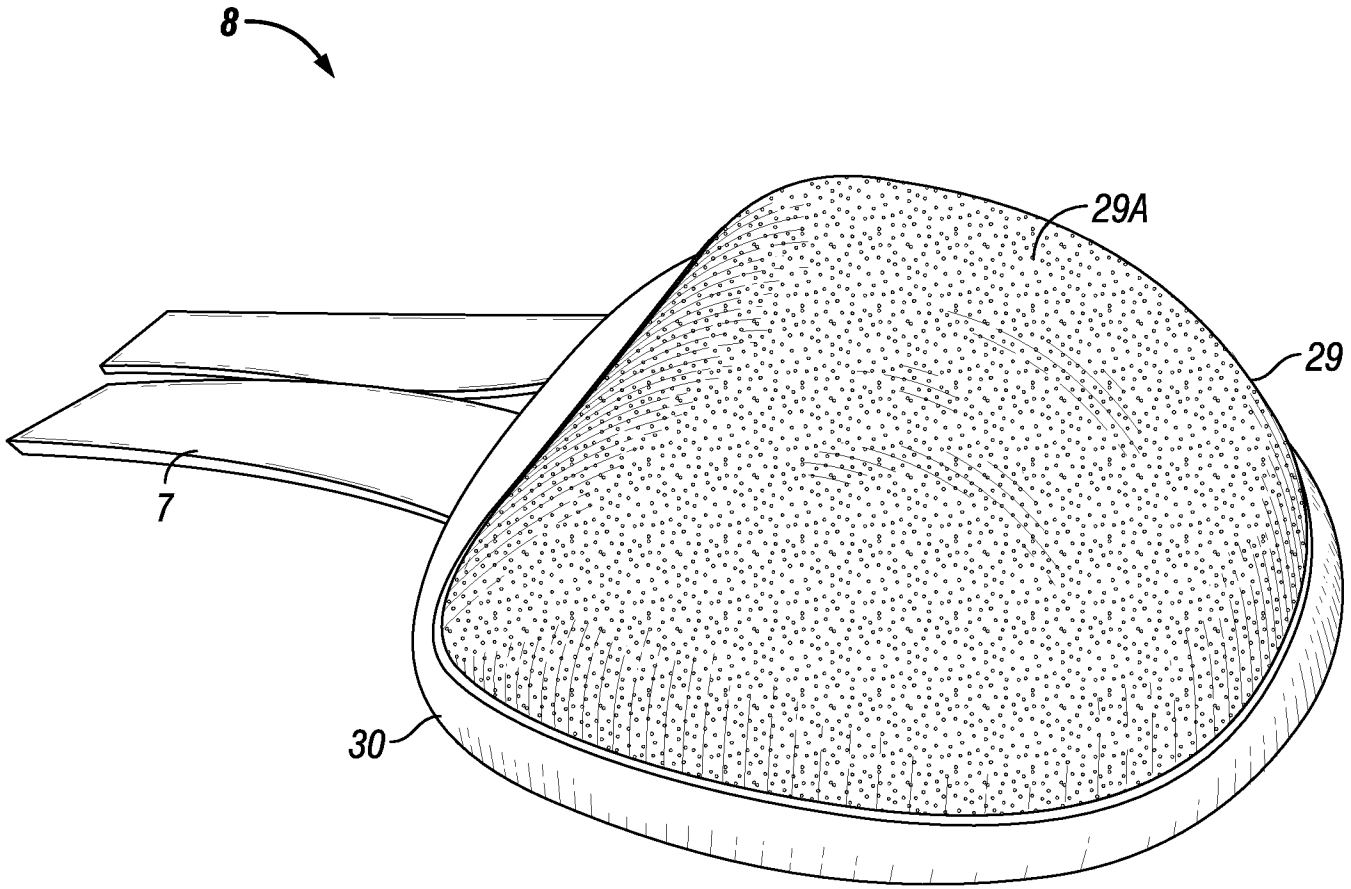
FIG. 24 is a simplified front perspective view of a shoulder cap assembly of this application.

In an embodiment as shown in FIG. 24, a shoulder cap assembly 8 may include one or more treatment members 10 defining a front surface layer 29A, the one or more treatment members 10 having a moisture regain of at least about 1.5 times the moisture regain of the materials of construction of the front surface of its corresponding chest protector 5. In another embodiment, a shoulder cap assembly 8 may include one or more treatment members 10 defining a front surface layer 29A having a moisture regain of at least about twice the moisture regain of the materials of construction of the front surface of its corresponding chest protector 5. In still another embodiment, a shoulder cap assembly 8 may include one or more treatment members 10 defining a front surface layer 29A having a moisture regain at least two times greater than the moisture regain of the materials of construction of the front surface of its corresponding chest protector 5. In another embodiment, a shoulder cap assembly 8 may include one or more treatment members 10 defining a front surface layer 29A having a moisture regain of at least about ten times the moisture regain of the materials of construction of the front surface of its corresponding chest protector 5.

As pointed out above, baseball chest protectors 5 typically include front side outer surfaces constructed from one or more synthetic textile materials providing strength and durability to chest protectors 5. Depending on the materials of construction and the process used to form the one or more textile materials, the outer surface of various chest protectors 5 may range in feel or touch to a person's skin. Typical competitive level chest protectors 5 may be constructed from one or more synthetic fibers ranging from about 70 denier to about 2100 denier. Accordingly, in one suitable embodiment of a shoulder cap assembly 8 for use with a competitive level baseball chest protector 5 defined by a front surface 5A fabric ranging from about 70 denier to about 2100 denier, the shoulder cap assembly 8 suitably includes one or more substance treatment member 10 textile materials comprising an average denier count less than the corresponding front surface 5A of the chest protector 5. In another embodiment, the shoulder cap assembly 8 suitably includes one or more substance treatment member 10 materials defining a front surface layer comprising micro-denier fibers.

Figure 25:
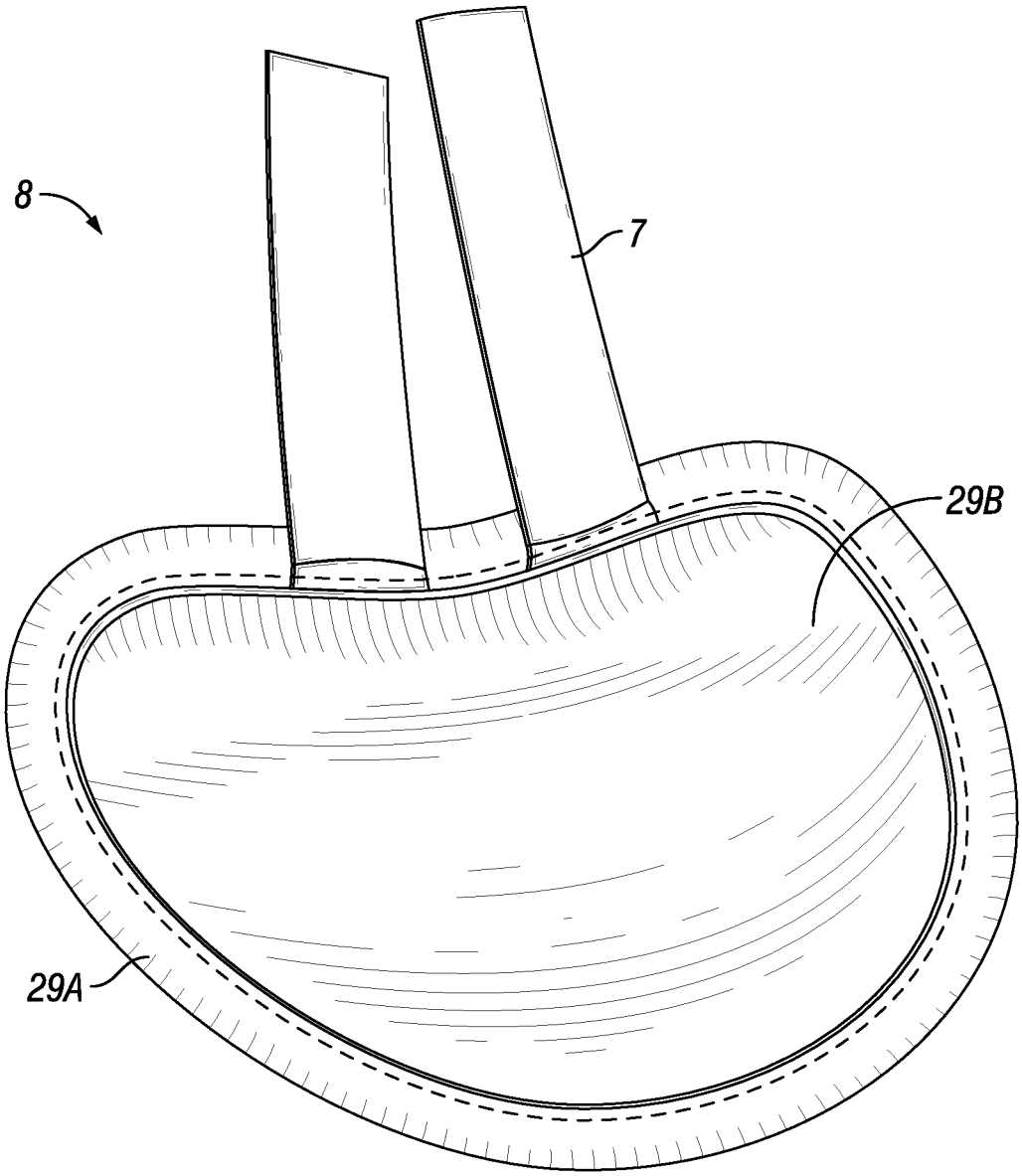
FIG. 25 is a back view of another embodiment of a shoulder cap assembly of this application.
Figure 26:
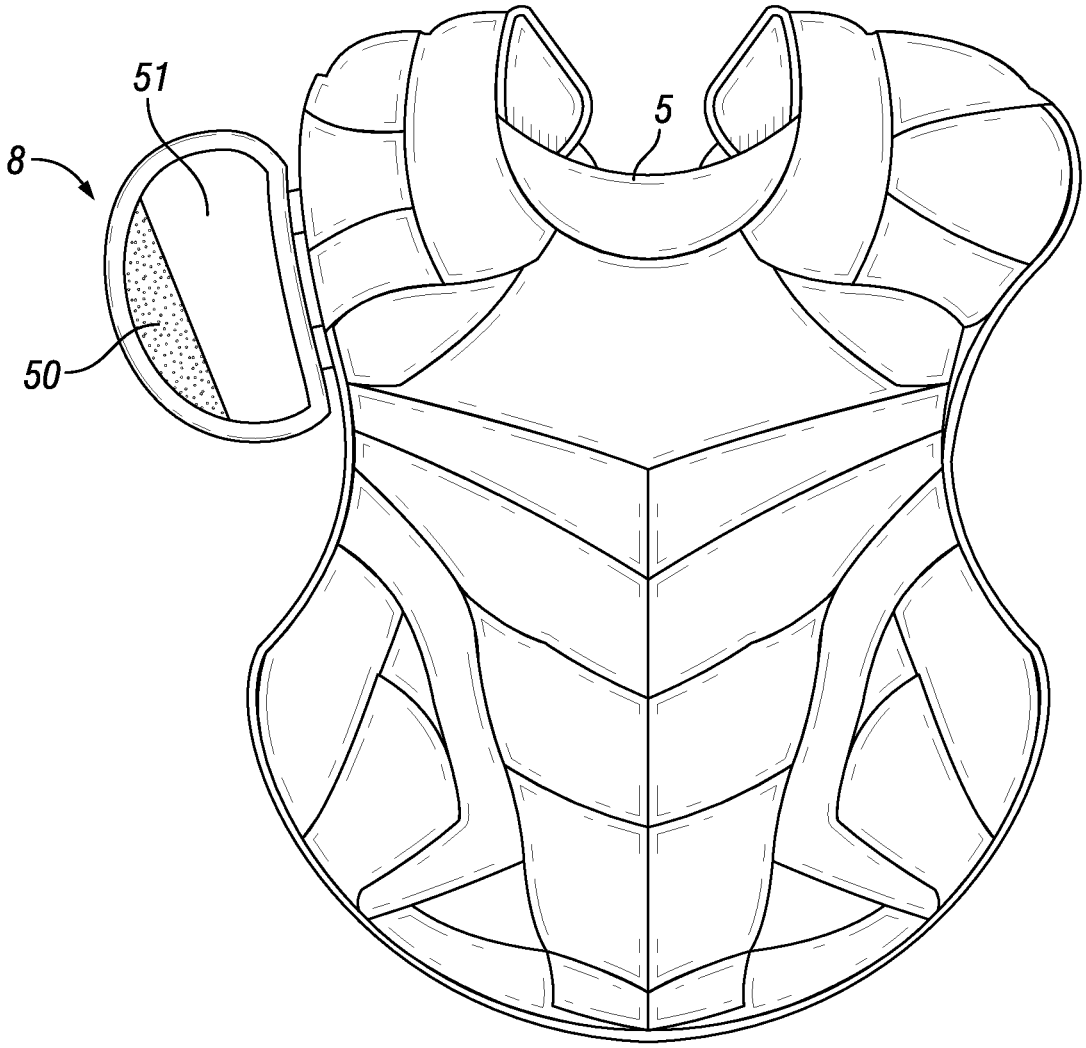
FIG. 26 is a front view of a chest protector including an embodiment of a shoulder cap assembly attached thereto.

In one exemplary embodiment of a shoulder cap assembly 8 of this application the front surface layer 29A of a shoulder cap 6 may include one or more treatment members 10 disposed thereon and secured via the perimeter binding 30. In the embodiment of FIG. 24, the front surface layer 29A is defined by a front surface 10A of a treatment member 10 constructed from a microfiber textile material. In another implementation, the front surface layer 29A of one or more treatment members 10 may extend over the perimeter 12 and be sewn along the back surface layer 29B of a shoulder cap 6 as shown in FIG. 25. In still another embodiment, as shown in FIG. 26, a shoulder cap assembly 8 may include one or more particular target areas 50 or removable members on the front surface of a shoulder cap 6 comprising one or more treatment members 10 and one or more non-target areas 51 comprised of materials of construction the 5 same or similar as the corresponding chest protector 5 front surface 5A. Other locations along the front surface of a shoulder cap 6 casing 29, in addition to or in place of the arrangement as shown in FIG. 26, may be employed as desired.

Figure 27:
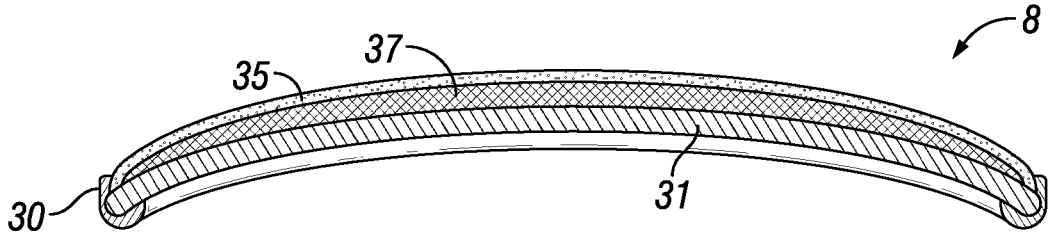
FIG. 27 is a sectional view of another embodiment of a shoulder cap assembly of this application.

With attention to FIG. 27, and without limiting the invention to any particular embodiments, in one suitable embodiment of a shoulder cap assembly 8 having a front surface layer 29A defined by at least two treatment member 10 layers 35, 37 disposed over one or more solid materials and/or shock-absorbing materials or shock-absorbing members 31, a first outermost surface layer 35 may include a hydrophobic moisture wicking material and the second succeeding layer 37 may include a hydrophilic moisture absorbing material, or vice versa. Exemplary hydrophobic moisture wicking layer materials of construction may include, but are not necessarily limited to (1) 100.0% polyester, (2) between 80.0% and 99.0% polyester and 1.0% to 20.00 spandex, and (3) synthetic microfiber fabric. Exemplary hydrophilic moisture absorbing layer materials of construction may include, but are not necessarily limited to (1) 100.0% cotton, (2) between 80.0% and 99.0% cotton and 1.0% to 20.0% polyester, (3) between 80.0% and 99.0% cotton and 1.0% to 20.0% nylon, (4) between 80.0% and 99.0% polyester and 1.0% to 20.0% polyamide, and (5) between 80.00 and 99.0% nylon and 1.0% to 20.0% polyamide. Suitable shock-absorbing materials or shock-absorbing members 31 may include, but are not necessarily limited to ethylene-vinyl acetate ("EVA"), polyethylene, polyurethane, vinyl nitrile, and combinations thereof. Similar as discussed above, shock-absorbing materials or shock-absorbing members 31 may be die cut from sheet stock or compression molded into three-dimensional forms. The shock-absorbing materials or shock-absorbing members 31 may also include one or more plastic members in place of or in addition to the above listed materials, one or more plastic members being disposed between and/or along one or more outer surfaces of one or more other shock-absorbing members 31.

It is also contemplated that in another embodiment each of the layers 35, 37 may be comprised of hydrophobic moisture wicking material. For example, the first and second layers 35, 37 may each comprise wicking material as describe above. In another example, the first and second layers 35, 37 may each comprise 100.0% polyester. In still another embodiment, each of the layers 35, 37 may be comprised of a hydrophilic moisture absorbing material as described above. For example, the first and second layers 35, 37 may each comprise 100.0% cotton.

In some embodiments, the first layer 35 and the second layer 37 may simply abut one another. In other embodiments, the first layer 35 and the second layer 37 may be mechanically joined to each other as known in the art of textiles. In other embodiments, the first layer 35 and the second layer may be joined along their outer edges. In still other embodiments, the two layers 35, 37 may be joined by adhesive bonding. In other embodiments, the first layer 35 and the second layer 37 may be joined to each other by lamination. In other embodiments, the first layer 35 and the second layer 37 may be joined to each other by sonic bonding.

In one or more embodiments, the first layer 35 and the second layer 37 may include similar thicknesses. In one or more embodiments, the first layer 35 and the second layer 37 may include a difference in thickness of less than about 6.35 mm (0.25 inches). In one or more embodiments, the first layer 35 and the second layer 37 may include a difference in thickness of about 6.35 mm or more (0.25 inches or more). In one or more embodiments, the fibers in the first layer 35 and the second layer 37 may be positioned in the same or substantially similar direction. In one or more embodiments, the first layer 35 and the second layer 37 may have the same estimated shrinkage percentage. In one or more embodiments, the first layer 35 and the second layer 37 may have different estimated shrinkage percentages.

Figure 28:
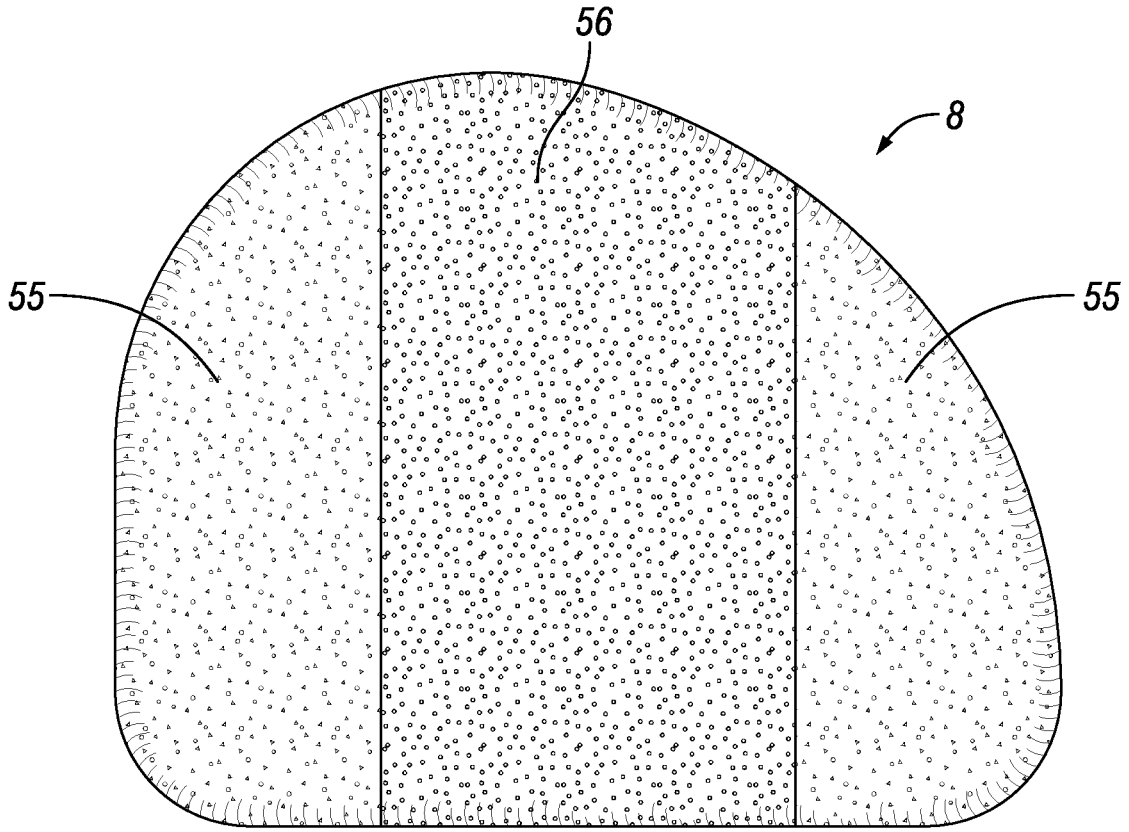
FIG. 28 is a front view of another simplified embodiment of a substance treatment member of this application.

Turning to FIG. 28, in another embodiment the front surface layer 29A of a shoulder cap assembly 8 may include one or more first sections 55 having a first material composition and one or more second sections 56 having a second material composition adjacent to or interspersed between the one or more first sections 55 including materials of construction as described above. In one non-limiting example, a first section 55 may include a hydrophobic moisture wicking material and a second section 56 may include a hydrophilic moisture absorbing material, or vice versa. In another embodiment, the front surface layer 29A may include two or more hydrophobic moisture wicking materials and two or more hydrophilic moisture absorbing materials.

Figure 29A:
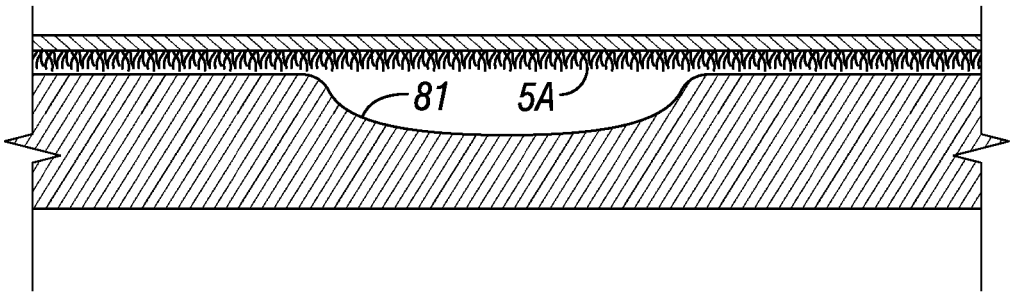
FIG. 29A is a simplified side view of a front surface of a chest protector in contact with a target surface.
Figure 29B:
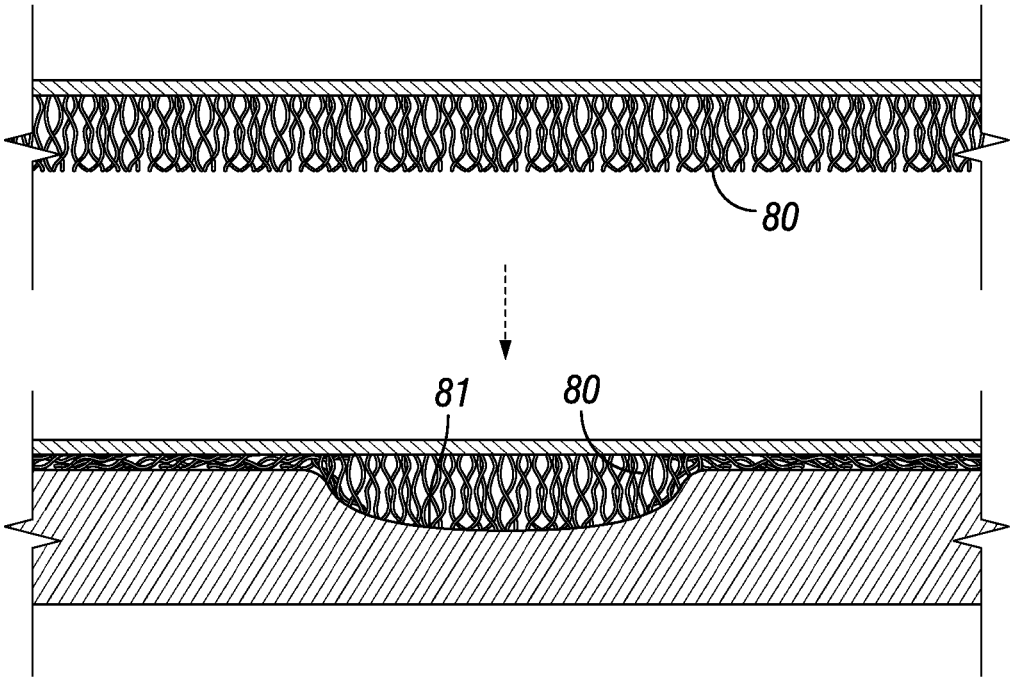
FIG. 29B is a simplified side view of a front surface of a treatment member in contact with the target surface of FIG. 29A.

In addition, the front outer surface of a treatment member 10 may be constructed from one or more materials providing (1) a raised surface of a depth and/or (2) a surface area greater than the one or more materials of construction of the front surface 5A of a corresponding chest protector 5. With attention to FIGS. 29A and 29B, a raised surface 80 of a treatment member 10 is effective to provide increased touching points along one or more non-planar target surfaces such as recessed surfaces 81 including, but not necessarily limited to crevices, cavities, pockets, dips, and concave surfaces. During baseball games, baseball catchers 99 often get dirt, chalk and sweat in their eyes and nose. By providing a treatment member 10 with a raised surface having (1) a depth greater than the corresponding materials of construction of the front surface 5A of the chest protector 5 and/or (2) a surface area greater than the corresponding front surface 5A, a shoulder cap assembly 8 of this application is operationally configured to reach or contact surfaces including, but not necessarily limited to the inner surface of a catcher's nose as well as the deepest parts of a person's eye sockets. Herein, such raised surface 80 feature may be referred to herein as "non-planar surface treatability."

Figure 30:
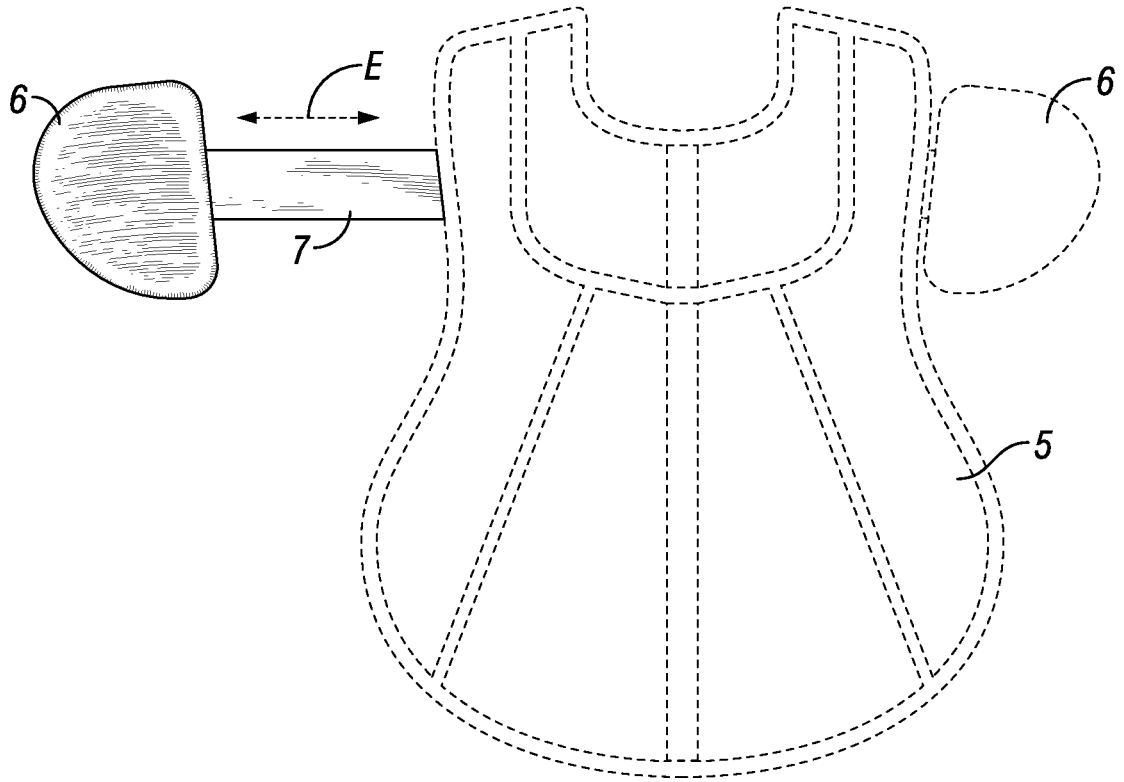
FIG. 30 is a front view of a chest protector including another embodiment of a shoulder cap assembly attached thereto.
Figure 33:
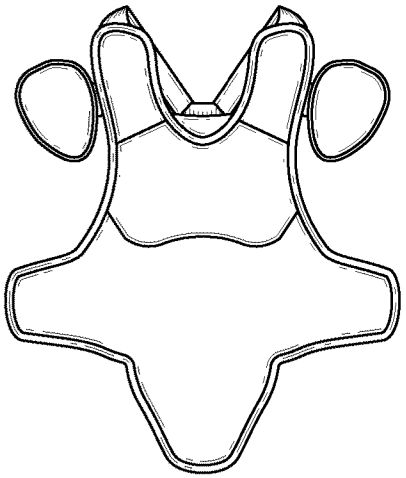
FIG. 33 is a front view of a known chest protector including shoulder caps corresponding to each of the right and left shoulders of a person to wear the chest protector.
Figure 32:
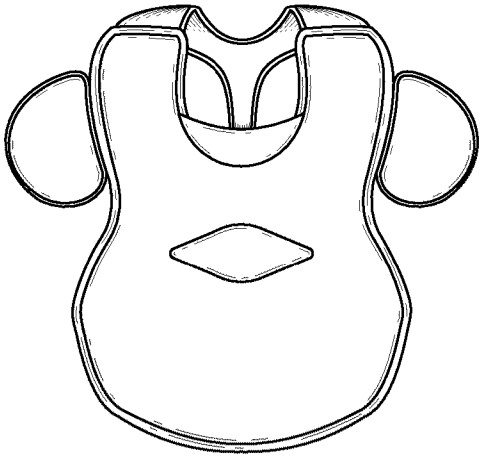
FIG. 32 is a front view of a known chest protector including shoulder caps corresponding to each of the right and left shoulders of a person to wear the chest protector.
Figure 31:
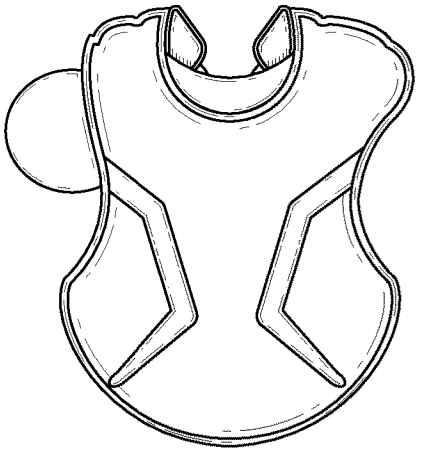
FIG. 31 is a front view of a known chest protector including a single shoulder cap corresponding to the right shoulder of a person to wear the chest protector.
Figure 36:
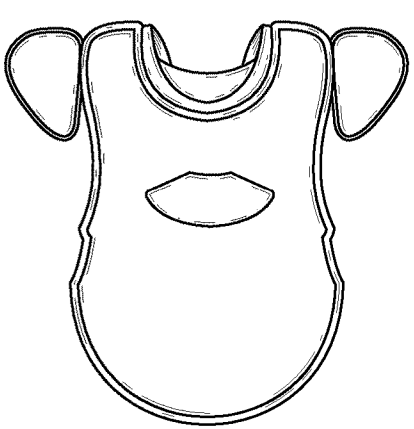
FIG. 36 is a front view of a known chest protector including shoulder caps corresponding to each of the right and left shoulders of a person to wear the chest protector.
Figure 35:
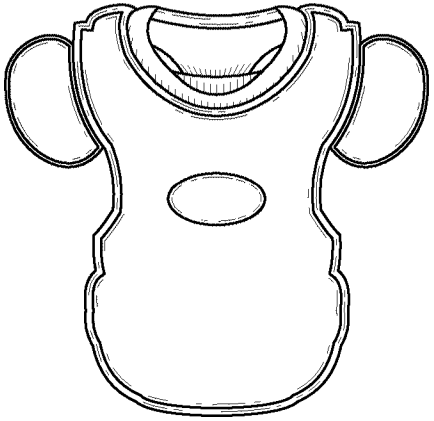
FIG. 35 is a front view of a known chest protector including shoulder caps corresponding to each of the right and left shoulders of a person to wear the chest protector.
Figure 34:
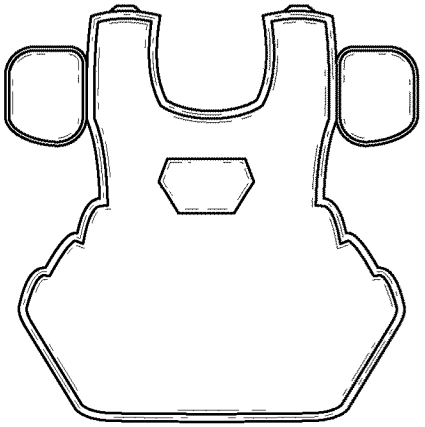
FIG. 34 is a front view of a known chest protector including shoulder caps corresponding to each of the right and left shoulders of a person to wear the chest protector.
Figure 37:
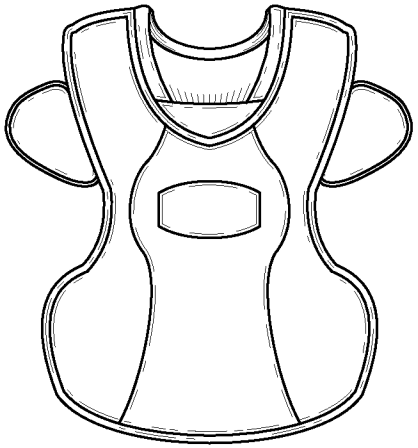
FIG. 37 is a front view of a known chest protector including shoulder caps corresponding to each of the right and left shoulders of a person to wear the chest protector.
Figure 38:
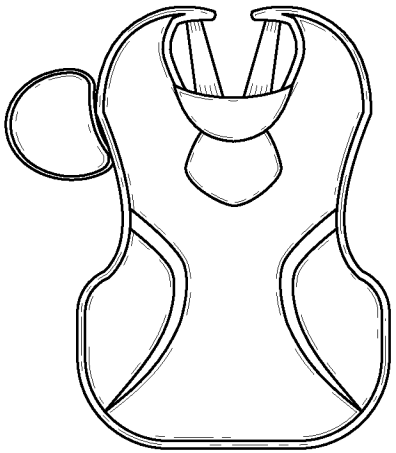
FIG. 38 is a front view of a known chest protector including a single shoulder cap corresponding to the right shoulder of a person of a person to wear the chest protector.
Figure 39:
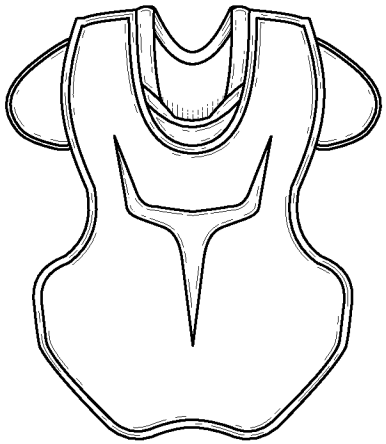
FIG. 39 is a front view of a known chest protector including shoulder caps corresponding to each of the right and left shoulders of a person to wear the chest protector.
Figure 40:
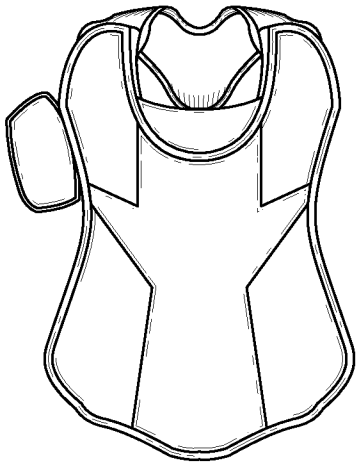
FIG. 40 is a front view of a known chest protector including a single shoulder cap corresponding to the right shoulder of a person of a person to wear the chest protector.
Figure 41:
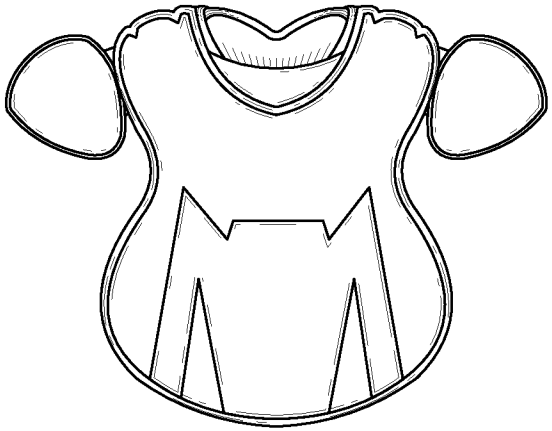
FIG. 41 is a front view of a known chest protector including shoulder caps corresponding to each of the right and left shoulders of a person to wear the chest protector.
Figure 42:
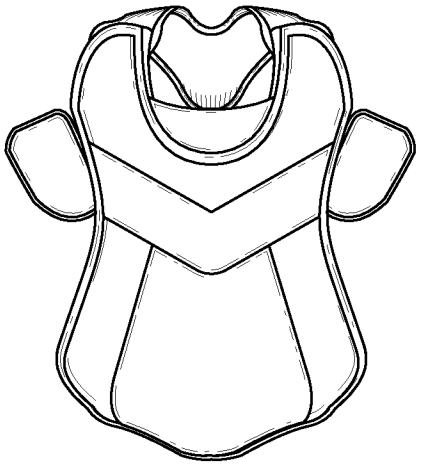
FIG. 42 is a front view of a known chest protector including shoulder caps corresponding to each of the right and left shoulders of a person to wear the chest protector.

Turning to FIG. 30, it is further contemplated that one or more attachment members 7 of a shoulder cap assembly 8 may be constructed from one or more elastic and/or resilient materials operationally configured to allow a user to direct the shoulder cap portion of the shoulder cap assembly 8 from a first resting position (see FIG. 11) to one or more second positions apart from the chest protector 5 and thereafter return the shoulder cap portion of the shoulder cap assembly 8 to its first resting position (see Arrow E). The ability to expand or stretch the one or more attachment members 7 provides a user with the ability to direct the shoulder cap portion of the shoulder cap assembly 8 to one or more target surfaces more easily without having to necessarily bring the one or more target surfaces toward the shoulder cap assembly 8. In a non-limiting example, one or more elastic and/or resilient attachment members 7 suitably allow a catcher 99 to bring the shoulder cap portion of the shoulder cap assembly 8 up to his/her face without having to tilt or lower the head and face downward as is depicted in FIG. 4, which includes operation of a shoulder cap assembly 8 having non-resilient attachment members 7.

In another embodiment of a shoulder cap assembly 8, at least part of the front surface of a base member such as a casing 29 of a shoulder cap 6 may include a removable layer 18 comprising one or more treatment members for purposes of changing out or replacing the removable layer 18 as desired. In this embodiment, the front surface of the casing 29 and the removable layer 18 may include one or more fasteners similar as described above in reference to FIG. 18. As described above, the removable layer 18 may be disposable. In the alternative, the removable layer 18 may be reusable and operationally configured for machine washing with other textiles and/or clothing.

The invention will be better understood with reference to the following non-limiting examples, which are illustrative only and not intended to limit the present invention to a particular embodiment.

Example 1

In a first non-limiting example, a chest protector system including a shoulder cap assembly 8 with a treatment member 10 as shown in FIG. 6 is provided having the following characteristics:

Chest Protector 5: Front surface 5A constructed from ballistic polyester satin Treatment Member 10: Front side 10A constructed from microfiber fabric.

Example 2

In another non-limiting example, a chest protector system including a shoulder cap assembly 8 with a treatment member 10 as shown in FIG. 6 is provided having the following characteristics:

Chest Protector 5: Front surface 5A constructed from ballistic polyester satin Treatment Member 10: Front side 10A constructed from 100.0% cotton fabric.

Example 3

In another non-limiting example, a chest protector system including a shoulder cap assembly 8 with a treatment member 10 as shown in FIG. 6 is provided having the following characteristics:

Chest Protector 5: Front surface 5A constructed from nylon satin

Treatment Member 10: Front side 10A constructed from 100.0% cotton fabric.

Example 4

In another non-limiting example, a chest protector system including a shoulder cap assembly 8 with a treatment member 10 as shown in FIG. 6 is provided having the following characteristics:

Chest Protector 5: Front surface 5A constructed from nylon satin

Treatment Member 10: Front side 10A constructed from a fabric having a 50/50 blend of cotton/polyester.

Example 5

In another non-limiting example, a chest protector system including a shoulder cap assembly 8 as shown in FIG. 24 is provided, the shoulder cap assembly 8 having an outer casing 29 defining a front surface layer 29A and back surface layer 29B with an edge binding 30 that is stitched to the front and back surface layers 29A, 29B along the perimeter 12. The chest protector 5 and shoulder cap assembly 8 are provided having the following characteristics:

Chest Protector 5: Front surface 5A constructed from polyester satin

Front surface layer 29A: Constructed from a fabric having a 50/50 blend of cotton/polyester.

Example 6

In another non-limiting example, a chest protector system including a shoulder cap assembly 8 as shown in FIG. 24 is provided, the shoulder cap assembly 8 having an outer casing 29 defining a front surface layer 29A and back surface layer 29B with an edge binding 30 that is stitched to the front and back surface layers 29A, 29B along the perimeter 12. The chest protector 5 and shoulder cap assembly 8 are provided having the following characteristics:

Chest Protector 5: Front surface 5A constructed from polyester satin

Front surface layer 29A: Constructed from 100.0% cotton fabric.

Example 7

In another non-limiting example, a chest protector system including a shoulder cap assembly 8 as shown in FIG. 24 is provided, the shoulder cap assembly 8 having an outer casing 29 defining a front surface layer 29A and back surface layer 29B with an edge binding 30 that is stitched to the front and back surface layers 29A, 29B along the perimeter 12. The chest protector 5 and shoulder cap assembly 8 are provided having the following characteristics:

Chest Protector 5: Front surface 5A constructed from polyester satin with fibers of about 100 denier or more.

Front surface layer 29A: Constructed from a microfiber fabric.

Example 8

In another non-limiting example, a chest protector system including a shoulder cap assembly 8 as shown in FIG. 24 is provided, the shoulder cap assembly 8 having an outer casing 29 defining a front surface layer 29A and back surface layer 29B with an edge binding 30 that is stitched to the front and back surface layers 29A, 29B along the perimeter 12. The chest protector 5 and shoulder cap assembly 8 are provided having the following characteristics:

Chest Protector 5: Front surface 5A constructed from polyester satin with fibers ranging from about 100 denier to about 1000 denier.

Front surface layer 29A: Constructed from a microfiber fabric.

Example 9

In another non-limiting example, a chest protector system including a shoulder cap assembly 8 as shown in FIG. 24 is provided, the shoulder cap assembly 8 having an outer casing 29 defining a front surface layer 29A and back surface layer 29B with an edge binding 30 that is stitched to the front and back surface layers 29A, 29B along the perimeter 12. The chest protector 5 and shoulder cap assembly 8 are provided having the following characteristics:

Chest Protector 5: Front surface 5A constructed from a textile having a moisture regain percentage of about 4.5 or less.

Front surface layer 29A: Constructed from a textile having a moisture regain percentage of about 8.0 or more.

Example 10

In another non-limiting example, a chest protector system is provided including a chest protector 5 and a shoulder cap assembly 8 comprising (1) a base member shoulder cap 6 as shown in FIG. 23 and (2) a removable treatment member 10 as shown in FIG. 6. The maximum thickness of the shoulder cap 6 is about six (6) times greater than the maximum thickness of the treatment member 10.

Example 11

In another non-limiting example, a chest protector system is provided including a chest protector 5 and a shoulder cap assembly 8 comprising (1) a base member or shoulder cap 6 as shown in FIG. 23 and (2) a removable treatment member 10 as shown in FIG. 6. The shoulder cap 6 is defined by a maximum thickness and the treatment member 10 is defined by a maximum thickness. When the treatment member 10 is attached to the shoulder cap 6 for shoulder cap assembly 8 operation, the maximum thickness of the shoulder cap assembly 8 is about 17.0 percent (17.0%) greater than the maximum thickness of the shoulder cap 6.

Example 12

In another non-limiting example, a shoulder cap assembly 8 as shown in FIG. 24 is provided with an outer layer and one or more inner layers of fabric of high modulus fibers, including, but not necessarily limited to poly(p-phenylene terephthalamide) (PPD-T).

Example 13

In another non-limiting example, a chest protector system is provided including a chest protector 5 and a shoulder cap assembly 8 comprising (1) a shoulder cap 6 as shown in any one of the illustrations of FIGS. 2-3, 31-42 and (2) a removable treatment member 10 as shown in FIG. 18. The chest protector 5 includes a front surface 5A constructed from a satin weave such as polyester satin, nylon satin, or a combinations thereof. The treatment member 10 includes one or more textiles operationally configured to cover the front surface of the shoulder cap 6. The one or more textiles of the treatment member 10 have a Wyzenbeek Abrasion Resistance less than the Wyzenbeek Abrasion Resistance of the satin weave of the front surface 5A of the chest protector 5 as tested according to ASTM D4157-Standard Test Method for Abrasion Resistance of Textile Fabrics (Oscillatory Cylinder Method).

Example 14

In another non-limiting example, a chest protector system is provided including a chest protector 5 having a front outer surface constructed from one or more textiles and a shoulder cap assembly 8 having a front outer surface constructed from one or more textiles. The one or more textiles defining the front surface of the shoulder cap assembly 8 have a Wyzenbeek Abrasion Resistance less than the Wyzenbeek Abrasion Resistance of the one or more textiles defining the front surface of the chest protector 5 as tested according to ASTM D4157-Standard Test Method for Abrasion Resistance of Textile Fabrics (Oscillatory Cylinder Method).

Example 15

In another non-limiting example, a chest protector system is provided including a chest protector 5 having a front outer surface constructed from one or more textiles and a shoulder cap assembly 8 having a front outer surface constructed from one or more textiles. The one or more textiles of the front surface of the chest protector 5 have a higher double rub count than the one or more textiles of the front surface of the shoulder cap assembly 8.

Example 16

Figure 43:
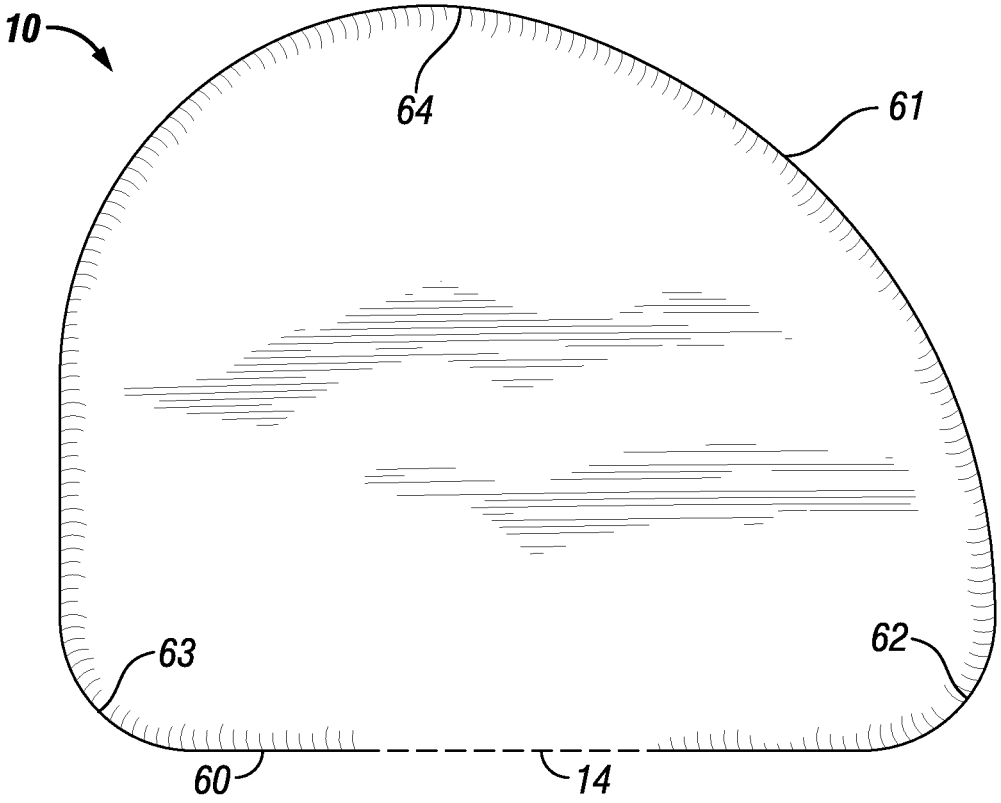
FIG. 43 is a front view of another simplified embodiment of a substance treatment member of this application.

In another non-limiting example, a removable treatment member 10 as shown in FIG. 43 is provided for use with a shoulder cap 6 as shown in FIG. 23. The treatment member 10 includes a perimeter 12 defined by a substantially linear front portion 60 with a centrally located mouth 14 and a non-linear rearward portion 61 extending from the right end of the front portion 60 to the left end of the front portion 60. The mouth 14 is operationally configured to receive the attachment members 7 there through. The rearward portion 61 has a first bend 62 defined by a first radius of curvature, a second bend 63 defined by a second radius of curvature and a third bend 64 defined by a third radius of curvature.

Example 17

In another non-limiting example, a chest protector system is provided including a chest protector 5 having a front outer surface constructed from one or more textiles having fibers of a first denier range and a shoulder cap assembly 8 having a front outer surface constructed from one or more textiles having fibers of a denier range different from the first denier range according to one or more anticipated target substances to be acted on by the shoulder cap assembly 8.

Example 18

In another non-limiting example, a chest protector system was provided including a chest protector 5, a shoulder cap assembly 8 releasably attachable to the chest protector 5 including a treatment member 10 as shown in FIG. 6 covering a base member in the form of a shoulder cap 6 as shown in FIG. 2. The chest protector 5 has an outer front surface 5A defined by a first textile composition of ballistic nylon fabric. The treatment member 10 has a front surface layer 29A defined by a textile composition of 82.0 polyester and 18.0 spandex high stretch knit with a weight of 271.2 grams per square meter (8.0 ounces per square yard).

Water in the amount of 3.7 milliliters (0.25 tablespoons) was placed atop a dry glass surface. About 5.1 $cm^2$ (2.0 square inches) of the front surface 5A of the chest protector 5 was swiped across the glass surface collecting about 1.0 percent of the water onto the first textile composition of the chest protector 5. The glass surface was dried with a paper towel. Water in the amount of 3.7 milliliters (0.25 tablespoons) was placed atop the dry glass surface a second time. About 5.1 $cm^2$ (2.0 square inches) of the front surface layer 29A of the treatment member 10 was swiped across the glass surface collecting about 10.0 percent of the water onto the treatment member 10.

Example 19

In another non-limiting example, a single piece of a 82.0% polyester and 18.0% spandex high stretch knit fabric having a weight of 271.2 grams per square meter (8.0 ounces per square yard) is folded to provide a front surface 10A and a back surface 10B and then cut to form a treatment member 10 as shown in FIG. 44 by sewing the front surface 10A and back surface 10B together along the perimeter 12 and providing a mouth 14 as shown. The treatment member 10 has the following dimensions:

D1: 11.43 cm (4.50 inches)
D2: 13.97 cm (5.50 inches)
D3: 17.78 cm (7.00 inches).

Example 20

In another non-limiting example, including a treatment member 10 as shown in any of FIGS. 5-10, 12-14, 16-22, 24, 27, 43-44, including at least two treatment member 10 layers, wherein (1) a first outermost surface layer 35 may include a hydrophobic moisture wicking material and the second succeeding layer 37 may include a hydrophilic moisture absorbing material, or (2) a first outermost surface layer 35 may include a hydrophilic moisture absorbing material and the second succeeding layer 37 may include a hydrophobic moisture wicking material, or (3) a first outermost surface layer 35 and a second succeeding layer 37 may have the same or substantially similar materials of construction. Exemplary hydrophobic moisture wicking layer materials of construction may include, but are not necessarily limited to (1) 100.0% polyester, (2) between 80.0% and 99.0% polyester and 1.0% to 20.0% spandex, and (3) synthetic microfiber fabric. Exemplary hydrophilic moisture absorbing layer materials of construction may include, but are not necessarily limited to (1) 100.0% cotton, (2) between 80.0%0 and 99.0% cotton and 1.0% to 20.0% polyester, (3) between 80.0% and 99.0% cotton and 1.0% to 20.0% nylon, (4) between 80.0% and 99.0% polyester and 1.0% to 20.00% polyamide, and (5) between 80.0% and 99.0% nylon and 1.0% to 20.0% polyamide.

Example 21

In another non-limiting example, a chest protector system including a shoulder cap assembly 8 including a treatment member 10 as shown in FIG. 6 is provided having the following characteristics:

Chest Protector 5: Front surface 5A constructed from ballistic nylon fabric.

Treatment Member 10: Front side 10A constructed from 82.0% polyester and 18.0% spandex high stretch knit with a weight of 271.2 grams per square meter (8.0 ounces per square yard).

Example 22

In another non-limiting example, a chest protector system including a shoulder cap assembly 8 including a treatment member 10 as shown in FIG. 6, excluding the attachment member 16, is provided having the following characteristics:

Chest Protector 5: Front surface 5A constructed from ballistic nylon fabric.

Treatment Member 10: Front side 10A constructed from a polyester spandex blend fabric.

Example 23

In another non-limiting example, a chest protector system including a shoulder cap assembly 8 including a treatment member 10 as shown in FIG. 6, excluding the attachment member 16, is provided having the following characteristics:

Chest Protector 5: Front surface 5A constructed from a nylon satin mesh fabric.

Treatment Member 10: Front side 10A constructed from a polyester spandex blend mesh fabric having a weight of 180.0 GSM.

Example 24

In another non-limiting example, a chest protector system including a shoulder cap assembly 8 including a treatment member 10 as shown in FIG. 6, excluding the attachment member 16, is provided having the following characteristics:

Chest Protector 5: Front surface 5A constructed from a breathable ballistic nylon.

Treatment Member 10: Front side 10A constructed from a medium weight polyester spandex fabric having a weight of about 275.0 GSM or less.

The present application is further directed to a chest protector system including a chest protector 5 with a front surface comprised of ballistic nylon of about 840 denier to about 1680 denier.

The present application is further directed to a chest protector system including a chest protector 5 with a front surface comprised of ripstop fabric as understood by persons of ordinary skill in the art of fabrics.

The present application is further directed to a shoulder cap assembly 8 including a removable outer surface effective to absorb impacts from moving objects such as baseballs and baseball bats similar as the textile composition of the front surface 5A of a corresponding chest protector 5 without being separated from the remaining shoulder cap assembly 8.

The present application is further directed to a chest protector system including a chest protector 5 including a front surface 5A constructed from a single fiber type and a shoulder cap assembly 8 including a front surface constructed from a fabric blend.

The present application is further directed to a chest protector system including a shoulder cap assembly 8 including a removable treatment member 10 comprised of a perimeter 12 defined by at least two curved sections.

The present application is further directed to a chest protector system including a shoulder cap assembly 8 having a removable treatment member 10 provided as a slip-on cover. In a first resting position the slip-on cover includes an outer perimeter of a first length. As a base member or shoulder cap 6 of a particular size is inserted within the slip-on cover, the perimeter of the slip-on cover increases to a length greater than the first length.

The present application is further directed to a chest protector system including a shoulder cap assembly 8 having a removable treatment member 10 provided as a slip-on cover having a perimeter adjustable in length.

The present application is further directed to a chest protector system including a shoulder cap assembly 8 having a removable treatment member 10 including one or more outer surfaces operationally configured to be written on or marked on via ink based writing instruments such as ink pens and markers. As such, an individual may write his/her name on the treatment member 10 to indicate ownership of the treatment member 10. In sports related applications, an athlete may write his/her signature onto the treatment member 10 as a gift or auction item.

The present application is further directed to a removable treatment member 10 for operation with a chest protector shoulder cap 6 whereby the treatment member 10 may be used for one or more treatment purposes different than the intended purpose(s) of the treatment member 10 in relation to the shoulder cap 6. In a non-limiting example, a treatment member 10 of this application may be removed from a shoulder cap 6 and used on surfaces such as table tops, counter tops, automobiles, floors, and other surfaces.

The present application is further directed to a removable treatment member 10 for operation with a chest protector shoulder cap 6 whereby if and when the treatment member 10 becomes saturated with one or more fluids, the treatment member 10 may be wrung out in a manner similar as known fabric pieces.

The present application is further directed to a removable treatment member 10 for operation with a chest protector shoulder cap 6 whereby the treatment member 10 has a front surface member defining a front surface 10A constructed from a first textile composition and a back surface member defining a back surface 10B constructed from a second textile composition. The first textile composition may include a higher specific strength, a lower specific strength or substantially the same specific strength as the second textile composition. The first textile composition may include a double rub count greater than, lower than, or substantially the same as the second textile composition.

Persons of ordinary skill in the art will recognize that many modifications may be made to the present application without departing from the spirit and scope of the invention. The embodiment(s) described herein are meant to be illustrative only and should not be taken as limiting the invention, which is defined in the claims.

We claim:

1. A chest protector system including:

a chest protector having a front outer surface and a back outer surface; and a shoulder cap assembly attachable to the chest protector, the shoulder cap assembly having a front outer surface and a back outer surface;

wherein the front outer surface of the chest protector comprises a first textile composition and at least part of the front outer surface of the shoulder cap assembly comprises a second textile composition, the first textile composition having a higher specific strength than the second textile composition.

2. The system of claim 1 wherein the shoulder cap assembly includes one or more attachment members operationally configured to releasably attach the shoulder cap assembly to the chest protector, the one or more attachment members comprising one or more elastic materials.

3. The system of claim 1 wherein the first textile composition has a first average denier count and the second textile composition has a second average denier count less than the first average denier count.

4. The system of claim 1 wherein the shoulder cap assembly includes a base member and one or more attachment members extending out from the base member, the base member including a front outer surface and one or more removable members covering at least part of the front outer surface of the base member, wherein the one or more removable members are operationally configured to provide the front outer surface of the shoulder cap assembly.

5. The system of claim 4 wherein the one or more removable members comprise a textile composition having a lower specific strength than the first textile composition.

6. The system of claim 4 wherein the one or more removable members have a front surface and an opposing back surface and includes one or more fasteners effective to secure a back surface of a first removable member to the front outer surface of the shoulder cap assembly and secure a back surface of a second removable member to a front surface of the first removable member.

7. The system of claim 1 wherein the second textile composition is operationally configured to act upon one or more target substances on one or more target surfaces and wherein the first textile composition has a first average moisture regain and includes one or more textiles having fibers of a first denier range and the second textile composition has a second average moisture regain greater than the first average moisture regain and includes one or more textiles having fibers of a denier range different from the first denier range according to the one or more target substances.

8. The system of claim 1 wherein the first textile composition has a double rub count greater than the second textile composition.

9. The system of claim 1 wherein the second textile composition comprises a fabric having a 50/50 blend of cotton/polyester.

10. The system of claim 1 wherein the first textile composition has a first moisture regain and the second textile composition has a second moisture regain of at least 1.5 times the first moisture regain.

11. The system of claim 1 wherein the first textile composition has a first moisture regain and the second textile composition has a second moisture regain of at least two times the first moisture regain.

12. The system of claim 1 wherein the first textile composition has a first moisture regain and the second textile composition has a second moisture regain of at least about ten times the first moisture regain.

13. The system of claim 1 wherein the second textile composition comprises a microfiber textile material.

14. The system of claim 1 wherein the second textile composition includes textiles selected from the group consisting of natural fibers, synthetic fibers, and combinations thereof.

15. The system of claim 1, the system further including a slip-on cover operationally configured to releasably attach to the shoulder cap assembly.

16. The system of claim 15 wherein the slip-on cover comprises one or more elastic materials.

17. A chest protector system including:

a chest protector having a front outer surface and a back outer surface, wherein the front outer surface comprises a first textile composition of a first average tenacity and a first average moisture regain; and a shoulder cap assembly attachable to the chest protector, the shoulder cap assembly having a front outer surface and a back outer surface, wherein at least part of the front outer surface of the shoulder cap assembly comprises a second textile composition of a second average tenacity less than the first average tenacity and a second average moisture regain greater than the first average moisture regain.

18. The system of claim 17 wherein the second textile composition comprises a microfiber textile material.

* * * * *